US011376172B2

(12) United States Patent
Bacon, IV

(10) Patent No.: US 11,376,172 B2
(45) Date of Patent: Jul. 5, 2022

(54) PATIENT TRANSPORTING DEVICE USING A DOCKING MEMBER FOR AN EMERGENCY MEDICAL VEHICLE

(71) Applicant: Dan Bacon, IV, Friday Harbor, WA (US)

(72) Inventor: Dan Bacon, IV, Friday Harbor, WA (US)

( * ) Notice: Subject to any disclaimer, the term of this patent is extended or adjusted under 35 U.S.C. 154(b) by 0 days.

(21) Appl. No.: 17/408,246

(22) Filed: Aug. 20, 2021

(65) Prior Publication Data

US 2022/0054331 A1 Feb. 24, 2022

Related U.S. Application Data

(60) Provisional application No. 63/068,765, filed on Aug. 21, 2020.

(51) Int. Cl.
*A61G 3/02* (2006.01)
*A61G 3/06* (2006.01)

(52) U.S. Cl.
CPC ..... *A61G 3/0263* (2013.01); *A61G 3/06* (2013.01); *A61G 2220/10* (2013.01); *A61G 2220/14* (2013.01)

(58) Field of Classification Search
CPC .... A61G 3/0263; A61G 3/06; A61G 2220/10; A61G 2220/00
See application file for complete search history.

(56) References Cited

U.S. PATENT DOCUMENTS 5,490,703 A * 2/1996 Hewko ..... A61G 1/0293 244/118.6
5,738,306 A * 4/1998 Moss ..... B64D 9/00 244/118.6
5,785,277 A * 7/1998 Manning ..... A61G 3/00 244/118.6
9,839,565 B1 * 12/2017 Harris ..... A61G 5/1089
2007/0124858 A1 * 6/2007 Ahlman ..... A61G 1/00 5/81.1 R
2008/0217910 A1 * 9/2008 Walke ..... A61G 12/002 285/121.7
2012/0117730 A1 * 5/2012 Lemire ..... A61G 7/005 5/611
2014/0090168 A1 * 4/2014 Coppens ..... A61G 7/103 5/81.1 R (Continued)

*Primary Examiner* — Hunter B Lonsberry
*Assistant Examiner* — Daniel L Greene
(74) *Attorney, Agent, or Firm* — Seed IP Law Group LLP

(57) ABSTRACT

The present disclosure provides a patient transporting device having a docking member at one end of the patient transporting device that allows to attach to and detach from a receiving portion of the patient loading systems in an emergency vehicle. The device includes a moveable base member that a patient lies down on, a pathway member for the base member to slidably move along tracks of the pathway member, and a docking member at one end of the pathway member that fits and mates with the receiving portion of the vehicle. In operation, the docking member docks with the receiving portion and establishes an extended bridge formed of the pathway member and the docking member of the device and the receiving portion of the vehicle. The extended bridge has a substantially coplanar surface so that the patient lying down on the base member may be easily loaded to the vehicle.

19 Claims, 25 Drawing Sheets

(56) References Cited

U.S. PATENT DOCUMENTS

| | | | | |
|---|---|---|---|---|
| 2014/0303477 | A1* | 10/2014 | Sunazuka | A61B 6/035 600/407 |
| 2014/0345045 | A1* | 11/2014 | Ferrin | A61G 3/063 5/81.1 HS |
| 2016/0022515 | A1* | 1/2016 | MacDonald | A61G 1/042 5/625 |
| 2016/0081864 | A1* | 3/2016 | Bradbury | A61G 1/007 187/241 |
| 2016/0338888 | A1* | 11/2016 | Michels | F16M 13/02 |
| 2017/0296404 | A1* | 10/2017 | Burkeen | A61G 3/0891 |
| 2019/0262204 | A1* | 8/2019 | Hertz | A61G 13/104 |
| 2019/0374412 | A1* | 12/2019 | Lazaro Caetano | A61G 1/04 |
| 2020/0008989 | A1* | 1/2020 | Mantovani | A61G 3/0875 |
| 2020/0038268 | A1* | 2/2020 | Shrapnel | A61G 3/0245 |
| 2020/0337917 | A1* | 10/2020 | Sales | A61G 1/04 |

* cited by examiner

PATIENT TRANSPORTING DEVICE USING A DOCKING MEMBER FOR AN EMERGENCY MEDICAL VEHICLE

BACKGROUND

Technical Field

The present disclosure relates to a device for loading and transferring patients into emergency medical vehicles, and more particularly to a docking portion of the device that docks to the emergency medical vehicles.

Description of the Related Art

Many of the products for loading and transferring patients such as stretchers are difficult to use because a docking portion of the stretchers are not compatible to a receiving portion (e.g., a corresponding portion that docks or mates with the docking portion) of a patient loading system that is inside the emergency medical vehicles such as airplanes, helicopters, or ambulances.

More often than not, there is no part in the patient loading system of the emergency medical vehicles for receiving the docking portion at all. This causes medical professionals to lift the stretcher where the patient is lying and manually move or carry the patient to the vehicle's patient loading system. Due to the weight of the patient, it generally requires quite a few personnel to help load the patient on the patient loading system of the emergency medical vehicle. However, this causes various problems. First of all, it is likely to take longer time and more medical personnel to unload the patient from the stretcher into the patient loading system of the emergency medical vehicle. Second, taking longer time to load the patient into the vehicle may risk the life of the patient who requires immediate medical attention. This also affects the cost of treating the patient, the quality of the treatment needed, the success rate of the treatment, and so forth. That is, the time it takes for the patient to get to the hospital by vehicle, unload the patient from the vehicle, and receive proper and timely medical care, heavily impacts the chances of the recovery and survival rate of the patient. Further, in a busy situation where on-site medical personnel in the hospital are lacking, the inconvenient patient loading and unloading mechanisms may additionally delay the patient from receiving timely medical treatment.

BRIEF SUMMARY

The present disclosure provides a patient transporting device with a docking member that can easily dock into the receiving portion of the patient loading system of the emergency vehicle.

The patient is initially loaded onto the patient transporting device that includes a movable base member where the patient lies down. The patient transporting device also includes a pathway member for slidably moving the base member along the frames or tracks of the pathway member. In addition, the patient transporting device includes a docking member that connects and docks the patient transporting device to the receiving portion of the patient loading system of the emergency vehicle.

In one or more embodiments, the docking member when docked forms a substantially coplanar surface with a top surface of the pathway member that abut the docking member. This allows the movable base member to easily slide from the pathway member over the docking member to the receiving portion of the emergency vehicle. With the docking member having the above mentioned configuration, it allows the movable base member where a patient is lying to easily move from the patient transporting device to the patient loading system of the emergency vehicle without undue effort. With the patient transporting device having a novel docking member, the number of medical assistant 120 required for handling each patient is substantially reduced and the effort of medical assistant 120 for lifting, loading, and unloading each patient is also reduced. For example, depending on the height, weight of the patient, with the old gurney in the related art, it required 3 or more medical assistant 120 to load and unload the patient. Further, the gurney in the related art, not only required more manpower it also consumed significant amount of energy of the medical assistant 120. Fatigue of the medical assistant 120 may result in further accidents.

The patient transporting device according to the present disclosure also provides a speedy mechanism for loading/unloading the patient. That is, the substantially coplanar surface formed between the patient transporting device and the emergency vehicle allows the patient on the moveable base member to smoothly slide up the ramp and quickly settle in the emergency vehicle.

In sum, because of the docking member, one or very few medical personnel can load/unload the patient. Further, because the docking member of the patient transporting device significantly reduces the time and effort involved in the load/unload process, it may increase the recovery and survival rate of the patient. In addition, with the help of the docking member, manufacturers need not have to worry about developing lightweight and yet strong materials for the patient transporting device. That is, even patients lying on heavy base member can be easily loaded onto the emergency vehicle.

BRIEF DESCRIPTION OF THE SEVERAL VIEWS OF THE DRAWINGS

Reference will now be made by way of example to the accompanying drawings. In the drawings, identical reference numbers identify similar elements or acts. In some drawings, however, different reference numbers may be used to indicate the same or similar elements. The sizes and relative positions of elements in the drawings are not necessarily drawn to scale. For example, the shapes of various elements and angles are not necessarily drawn to scale, and some of these elements may be enlarged and positioned to improve drawing legibility.

DETAILED DESCRIPTION

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures, configurations, or methods associated with patient transporting devices (such as stretchers), patient loading/unloading system in medical emergency vehicles (such as aircrafts, helicopters, ambulances, etc.), and other various structures associated with the above have not been shown or described in detail to avoid unnecessarily obscuring descriptions of the embodiments.

Unless the context indicates otherwise, throughout the specification and claims which follow, the word "comprise" and variations thereof, such as, "comprises" and "comprising" are to be construed in an open, inclusive sense that is as "including, but not limited to." Further, the terms "first," "second," and similar indicators of the sequence are to be construed as interchangeable unless the context clearly dictates otherwise.

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is, as meaning "and/or" unless the content clearly dictates otherwise.

Figure 1A:
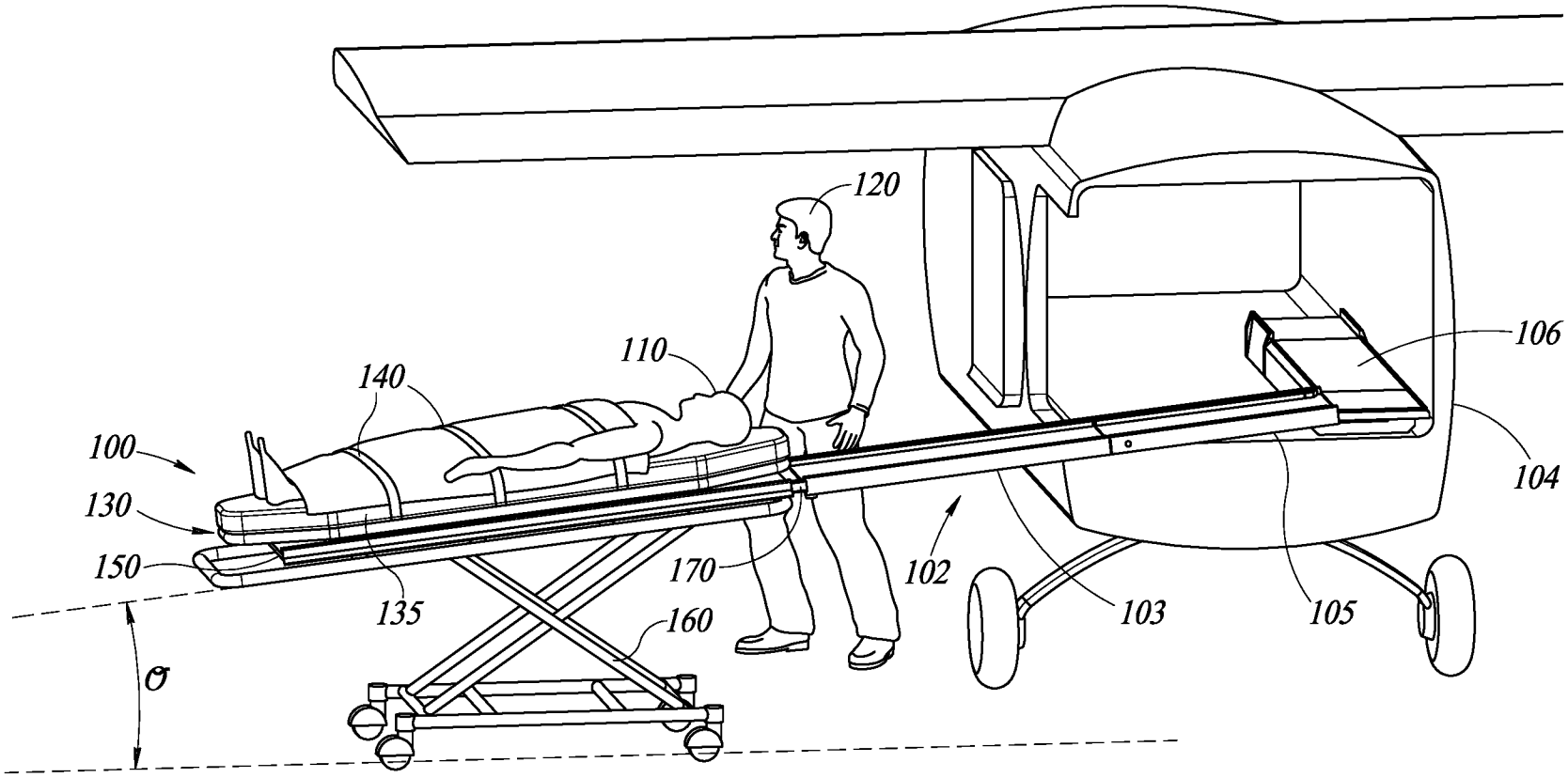
FIG. 1A illustrates a patient transporting device according to the present disclosure docking into a receiving portion of a patient loading system of an emergency medical vehicle.

FIG. 1A illustrates a patient transporting device 100 according to the present disclosure docking into a receiving portion 102 of a patient loading system of an emergency medical vehicle 104. In FIG. 1, a patient 110 is lying on the patient transporting device 100 and is being prepared to be loaded into the emergency vehicle 104 by a medical assistant 120. In order to use an emergency vehicle 104 for loading patients for medical purposes, the vehicle 104 must have equipment proper for loading and unloading the patient 110. The specific structures and configurations of the patient loading system within the emergency vehicle 104 will be omitted and the receiving portion 102 of the patient loading system will be explained to avoid any unnecessary descriptions. In some embodiments, the receiving portion 102 of the patient loading system includes a ramp structure 103 having a first portion 103A and a second portion 103B connected to the first portion 103A, and a patient bed structure 106 connected to the first portion 103A of the ramp structure 103. To reduce size, the ramp structure 103 can be folded in half along the line between the first portion 103A and the second portion 103B.

Airplanes, helicopters, and ambulances are commonly used to transport patients to medical facilities or health care facilities. FIG. 1 shows an aircraft as an emergency vehicle 104, however, other emergency vehicles or rescue vehicles mentioned above may be contemplated. In some embodiments, the patient loading system of the present disclosure includes the novel patient transporting device 100 as well as the receiving portion 102 of the emergency vehicle 104. The emergency vehicle 104 is expected to be equipped with standard patient medical equipment that can accommodate the patient's need during transportation such as oxygen supply, IV, or the like. These medical equipment is included in the patient bed structure 106 where the patient eventually lies down and rests during transportation to the hospital. Any features of related art will be omitted as a person of ordinary skill in the art would readily appreciate and understand the features.

The receiving portion 102 of the present disclosure have been further modified from the standard patient transporting device in the related art as will be further detailed herein. The receiving portion 102 of the emergency vehicle 104 have been modified by the inventor so that it has a size, shape, and dimension (e.g., length, width, height, etc.) that substantially matches or fits the width and dimension of a pathway member 150 of the patient transporting device 100. Having the moveable base member 130 slide from the patient transporting device 100 to the emergency vehicle 104 obviates the need for the patient 110 to transfer from one type of movable base member, table, tray, bed, or bedplate to another. Further, the patient 110 may remain on the same position within the movable base member 130 of the emergency vehicle 104 during the transfer and the transport procedure (e.g., loading from the patient transporting device 100 to the emergency medical vehicle 104, unloading from the vehicle 104 to another patient transporting device at a hospital site, transporting the patient on the patient transporting device to an emergency room, etc.). Because the conventional patient loading system lacks a docking member 170 that easily connects the receiving portion 102 of emergency vehicle 104 with the pathway member 150 of the patient transporting device 100, this aspect will be detailed throughout the specification. In some embodiments, the patient transporting device 100 includes a stretcher, a gurney, or the like. However, the patient transporting device 100 is further modified from the stretcher or the gurney in the related art in many ways which will be described in connection with the accompanying figures. In some embodiments, the patient transporting device 100 further includes a pathway member 150 movably attached to the gurney. In one embodiment, it may be permanently fixed to the gurney. In one embodiment, it may be securely fixated to the gurney but could detached. The patient transporting device 100 also includes a moveable base member 130 on the pathway member 150.

In some embodiments, the pathway member 150 is similar to a ramp shape or ramp structure.

The base member or the moveable base member 130 of the patient transporting device 100 includes a bed portion, or a bedplate portion, or a bedplate assembly, or a frame plate, or a table, or a tray, or the like for the patient 110 to lie down. This is the top portion of the moveable base member 130. In the bottom portion of the moveable base member 130, a slidable sled-shaped member is included. For example, the sled-shaped member may have a frame that is shaped as a bed-like sled and includes a space for the patient 110 to lie down. A soft cloth, cushion, or a mattress 135 can be positioned on top of the base member 130 so that the patient 110 may comfortably lie down. The base member 130 has a plurality of belt straps 140 or tie-down straps 140 on each side of the periphery of the base member 130 so that it may lock the position of the patient 110 during movement. The mattress 135 may have the same contours of the frame of the base member 130 so that the mattress 135 does not impede the movement of the base member 130 during operation. In some embodiments, the base member 130 may be made of metal, stainless steel, or plastic. In some embodiments, the base member 130 includes a structural tubular frame. The tubular frame may provide lightweight support for the patient 110. After the patient 110 is placed on the base member 130, the patient is secured using the belt straps 140 and the base member 130 is placed within the emergency vehicle and fastened for safe transportation. These examples are non-limiting and other suitable materials may be used as known in the art.

The base member 130 is positioned on a pathway member 150 of the patient transporting device 100. The pathway member 150 provides the base member 130 a pathway for slidably moving the base member 130 from one position within the patient transporting device 100 to another position. The pathway member 150 includes interlocking mechanisms so that once the moveable base member 130 locks into the interlocking mechanism, the lateral or longitudinal movement of the patient lying on the base member 130 is limited. This is one safety feature of the pathway member 150 and this will be further detailed in connection with FIGS. 3D, 10, FIGS. 11A, 11B, and 11C. The pathway member 150 also provides the base member 130 a pathway for slidably moving the base member 130 from the patient transporting device 100 to the emergency vehicle 104 via the receiving portion 102.

Prior to transporting the patient 110 to the emergency vehicle 104, the base member 130 must be secured to the pathway member 150 using the interlocking mechanism of the pathway member 150. In some embodiments, the base member 130 includes a generally rectangular, peripheral frame member. The base member 130 may have thereon a cushion, a sheet, or a mattress or similar soft material so that the patient 110 may comfortably lie on. In some embodiments, the base member 130 may include support frames or bars that extends longitudinally (e.g., extends all the way down to the foot of the patient 110 and extend all the way up to the head of the patient 110 on the right and left sides of the base member 130). These support frames or bars can provide a place for the medical assistant 120 to hold on to and push the patient longitudinally along the In one or more embodiments, the base member 130 and the pathway member 150 have compatible components for releasably locking and unlocking the position with each other. The pathway member 150 includes one or more trenches, grooves, slots, recesses, or tracks along its opposite longitudinal sides. For example, the pathway member 150 may have tracks cut into the pathway member 150. The tracks may have an opening on the ends of the tracks so that the base member 130 can easily be mounted on and slidably move along the tracks of the pathway member 150. The tracks may also have a brake or interlocking mechanism (e.g., brakes, pins, detents, stops, locking gates, or the like) to further prevent the base member 130 from sliding out of the patient transporting device 100. In some embodiments, the tracks may have additional brakes or stops or detents to prevent the base member 130 from lateral, vertical, horizontal movements. In some embodiments, the brakes or brake mechanisms in the pathway member 150 may include hooks that may hook to a part of the base member 130 to prevent forward/backward or upward/downward movement of the base member 130. These brakes may be released when the patient 110 is to be moved to the emergency vehicle 104.

In some embodiments, the pathway member 150 may have tracks that align like a railway. That is, the pathway member 150 may have two railway-like paths, a first path and a second path, that are parallel to each other. For example, there may be a first path on one side, and a second path on the opposite side of the pathway member 150. In some embodiments, the base member 130 may have wheels on the bottom of the movable base member 130 so that the wheels are placed respectively on the first path and the second path. In other embodiments, the pathway member 150 may be implemented to have a single rail-like track or trench that provides a pathway for the base member 130. In these embodiments, the wheels of the base member 130 would also have to be configured to accommodate the single rail of the pathway member 150. Such wheels may be attached to the bottom of the base member 130 using wheel brackets. These wheels are sizably matched so that it may roll along the trenches or the tracks.

In other embodiments, the movable base member 130 may not need wheels. The trenches in the pathway member 150 guide the moveable base member 130 for linear movement along the elongated linear trenches/slots formed in the pathway member 150. That is, the movement of the base member 130 is guided by trenches or tracks fitted in the pathway member 150. In addition, as previously described, the moveable base member 130 can be locked in a desired position by locking pins in the two tracks to prevent the moveable base member 130 from sliding down in an opposite direction during loading of the patient 110 into the vehicle 104. One or more locking pins are provided, one for each track. The moveable base member 130 may include other components, structures that allow slidable movement along the pathway of the pathway member 150.

The pathway member 150 is supported by a lift assembly 160 or a lifter. The lift assembly 160 is configured to lift and tilt the patient 110 in any inclination. In one or more embodiments, the lift assembly 160 is capable of controlling the angle θ as shown in FIG. 1. In operation, the lift assembly 160 lifts the patient transporting device 100 and tilts the patient transporting device 100 at a selected angle to dock a docking member 170 to the receiving portion 102 of the emergency vehicle 104. FIG. 1D illustrates that the lift assembly 160 can be operated by the medical assistant 120 to lift up the receiving portion 102 beyond angle θ which is the angle that forms a substantially planar pathway between the pathway member 150 and the receiving portion 102. The lifting operation is particularly beneficial since the next step for the medical assistant 120 is to level the patient with the inside floor surface 1200 (see FIG. 12C) of emergency vehicle 104. It is beneficial for the receiving portion 102 which includes the ramp structure 103 to be substantially parallel to the inside floor surface 1200 so that the patient is secured in a safe position and does not fall of the ramp structures. Generally, the patient bed structure 106 is already placed within the emergency vehicle 104 and is securely fixed. Accordingly, the inclination of the ramp structure 103 is adjusted to level the patient 110. Additional structure which is a leveling structure 109 for leveling the patient is described in FIGS. 1F, 12A, 12B, and 12C.

In one or more embodiments, the pathway member 150 includes sidewall structures 201 to easily guide the movement of the moveable base member 130 as well as help avoid the base member 130 from derail and run off the pathway member 150. In some embodiments, the sidewall structures 201 have a tapered shape. In these embodiments, the moveable base member 130 slidably moves along the sidewall structures 201 of the pathway member 150. The sidewall structure 201 can be coupled to the pathway member 150 to accommodate the different dimensions (e.g., width, length, height, etc.), sizes, shapes, patterns of many different manufacturers. The add-on sidewall structures 201 which may or may not be permanently fixated to the pathway member 150 is particularly beneficial to accommodate the different dimensions manufactured by various manufacturers. The sidewall structures 201 (including 201AL, 201AR, 201BL, 201BR, 201CL, and 201CR) may be formed using plastics, metals, stainless steel, or the like. One example material of the sidewall structures 201 include an ultra high molecular weight polyethylene (UHMW). The UHMW is an extremely tough plastic with high abrasion and also has high impact resistance properties and wear resistance. However, the material of the sidewall structures are not limited to the above and a person of ordinary skill in the art may form the sidewall structures with other materials suitable for the function and purpose as described herein.

The lift assembly 160 may have wheels or other moveable means to easily transport the patient 110.

Figure 1B:
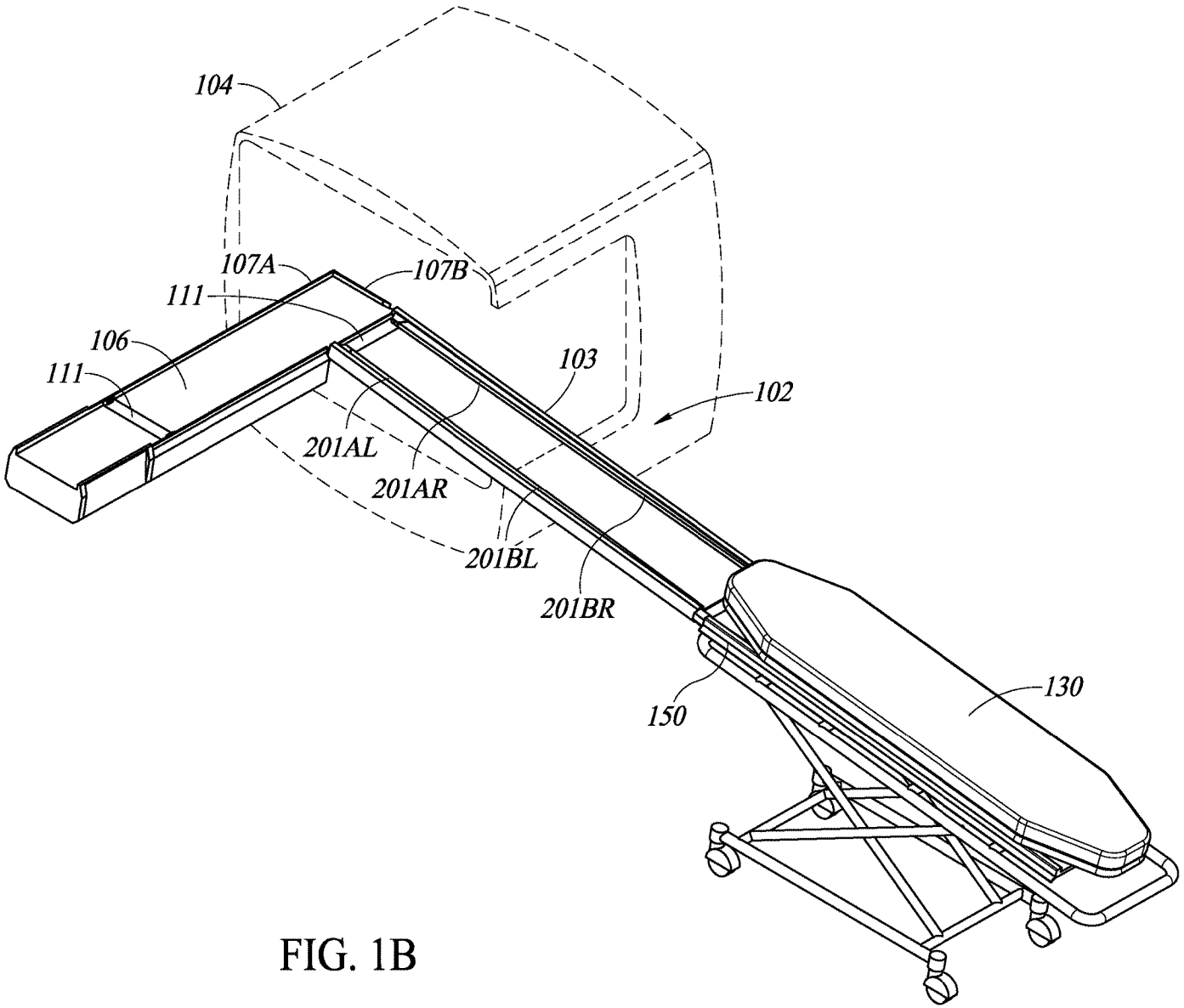
FIG. 1B illustrates a patient transporting device according to a different perspective view from FIG. 1A.

FIG. 1B illustrates a patient transporting device according to a different perspective view from FIG. 1A. FIG. 1B through FIG. 1H have been illustrated without showing the patient on the moveable base member 130 in order to provide a better view of one or more features of the present disclosure. FIG. 1A through FIG. 1H illustrate one continuous motion transition of the moveable base member 130 according to some embodiments of the present disclosure.

As shown in FIG. 1B, the moveable base member 130 sits on the pathway member 150. The pathway member 150 forms a substantially planar surface with the first portion 103A and the second portion 103B of the ramp structure 103. FIG. 1C through FIG. 1H illustrate the movement of the base member 130 from the patient transporting device 100 into the emergency vehicle 104.

A first left sidewall 201AL and a first right sidewall 201AR is provided on the first portion 103A of the ramp structure 103. A second left sidewall 201BL and a second right sidewall 201BR is provided on the second portion 103B of the ramp structure 103. These sidewalls which are moveably attached to inner sidewalls of the first and second portions of the ramp structure guides the moveable base member 130 up the ramp without the base member 130 laterally running off the ramp. The detail of the sidewall structures will be further explained in connection with FIGS. 1I and 3C.

Figure 1C:
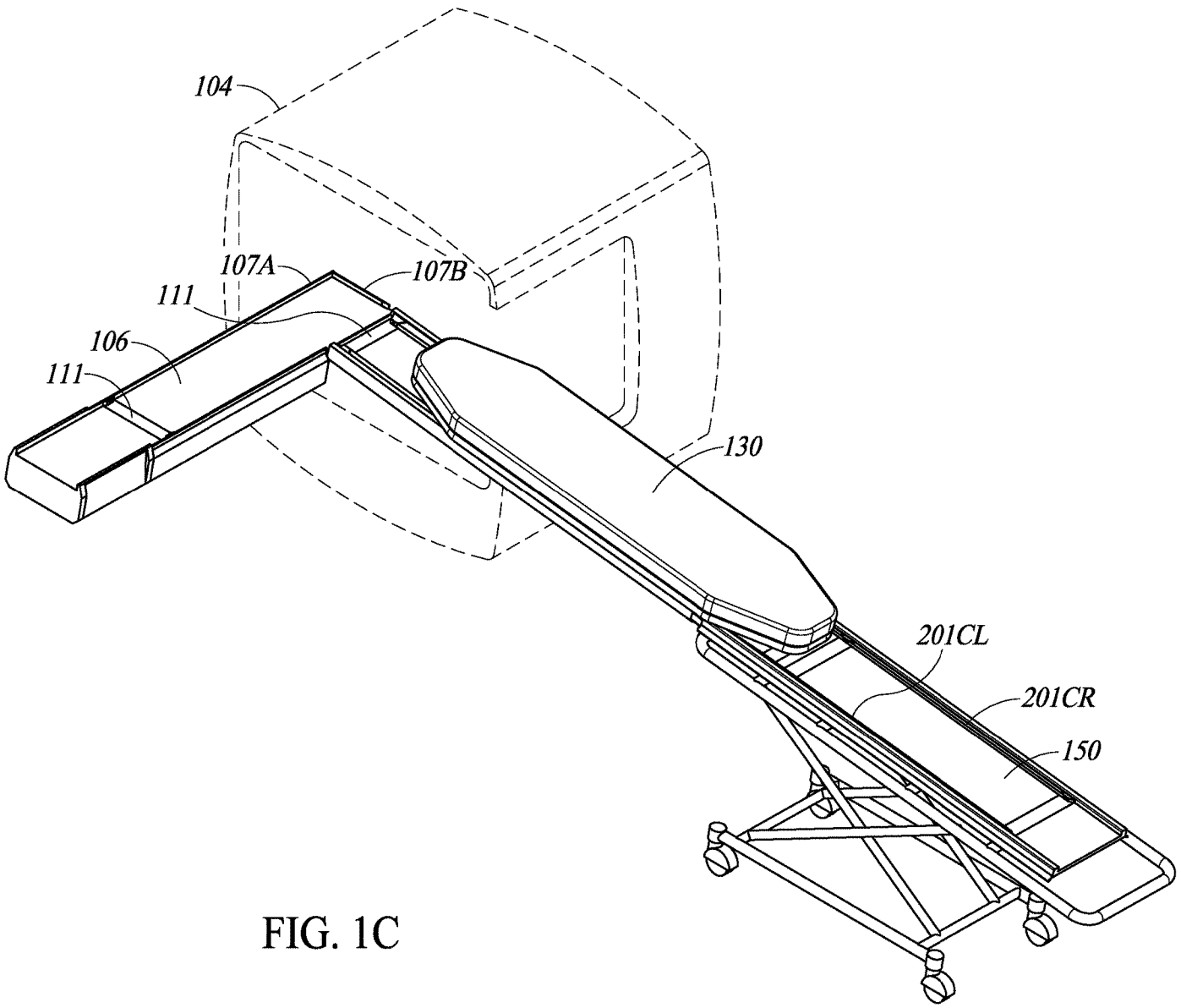
FIG. 1C illustrates a patient transporting device moving up the ramp shown in FIG. 1B.
Figure 1D:
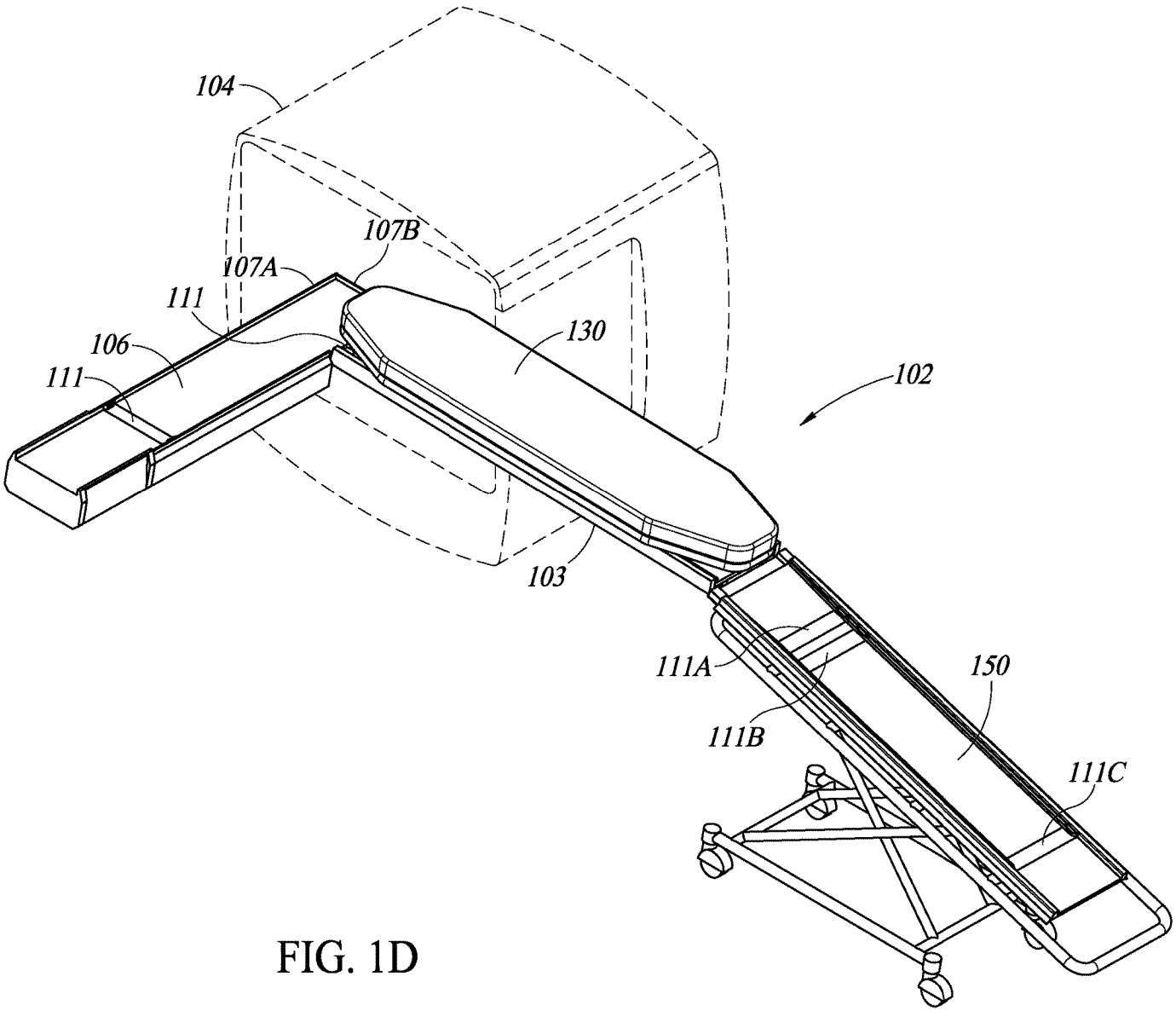
FIG. 1D illustrates a patient transporting device lifting up the ramp shown in FIG. 1B to level the ramp with a surface of the emergency medical vehicle shown in FIG. 1A.

FIG. 1C illustrates a patient transporting device moving up the ramp shown in FIG. 1B. As shown in FIG. 1C, the moveable base member 130 is in motion and is passing the second portion 103B of the ramp structure 103. The inclination angle θ as shown in FIG. 1A is maintained so that the moveable base member 130 can slidably and smoothly move up the ramp structure.

FIG. 1D illustrates a patient transporting device lifting up the ramp shown in FIG. 1B to level the ramp with a surface of the emergency medical vehicle shown in FIG. 1A. As shown in FIG. 1D, once the moveable base member 130 reaches the first portion 103A of the ramp structure 103, the moveable base member 130 is locked in with a first locking mechanism 105 adjacent to one end of the first portion 103A of the ramp structure 103. This locking feature allows the patient to maintain its current position within the ramp and avoid the moveable base member 130 from slipping down the ramp structure 103. The patient transporting device 100 further lifts the pathway member 150 beyond the inclination angle θ as shown in FIG. 1A. The substantially coplanar surface that was formed between the pathway member 150 and the ramp structure 103 is broken. However, this is beneficial since the patient on the moveable base member 130 has to now be substantially parallel with an inner floor surface 1200 (shown in FIG. 12C) of the emergency vehicle 104. In order to maintain a stable position that supports and levels the ramp structure 103 with respect to the inner floor surface 1200, a leveling structure 109 is provided. A detailed view is shown in FIG. 1F and FIG. 12C.

Figure 1E:
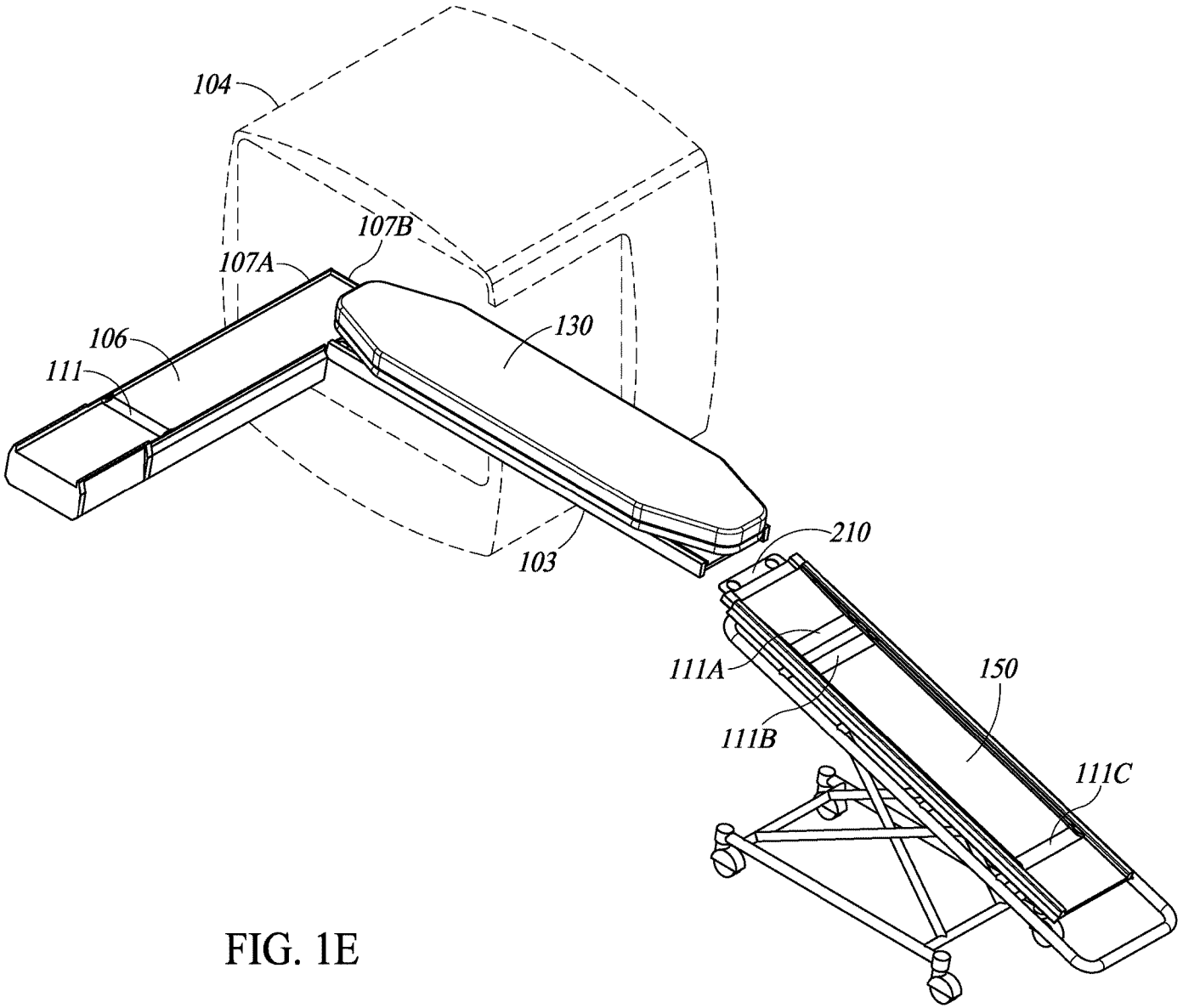
FIG. 1E illustrates a patient transporting device according to the present disclosure unlocking with the ramp shown in FIG. 1B to release connection with the ramp.

FIG. 1E illustrates a patient transporting device according to the present disclosure unlocking with the ramp shown in FIG. 1B to release connection with the ramp. Once the leveling structure 109 is unfolded from the bottom of the ramp structure 103 and stably sits on the inner floor surface 1200 of the emergency vehicle 104, the docking plate 210 of the device 100 is released from the ramp structure 103. At this point, the ramp structure 103 is substantially parallel to the inner floor surface 1200 of the emergency vehicle 104 and the medical assistant 120 only needs to shift the base member 130 to the final position in the patient bed structure 106.

Figure 1F:
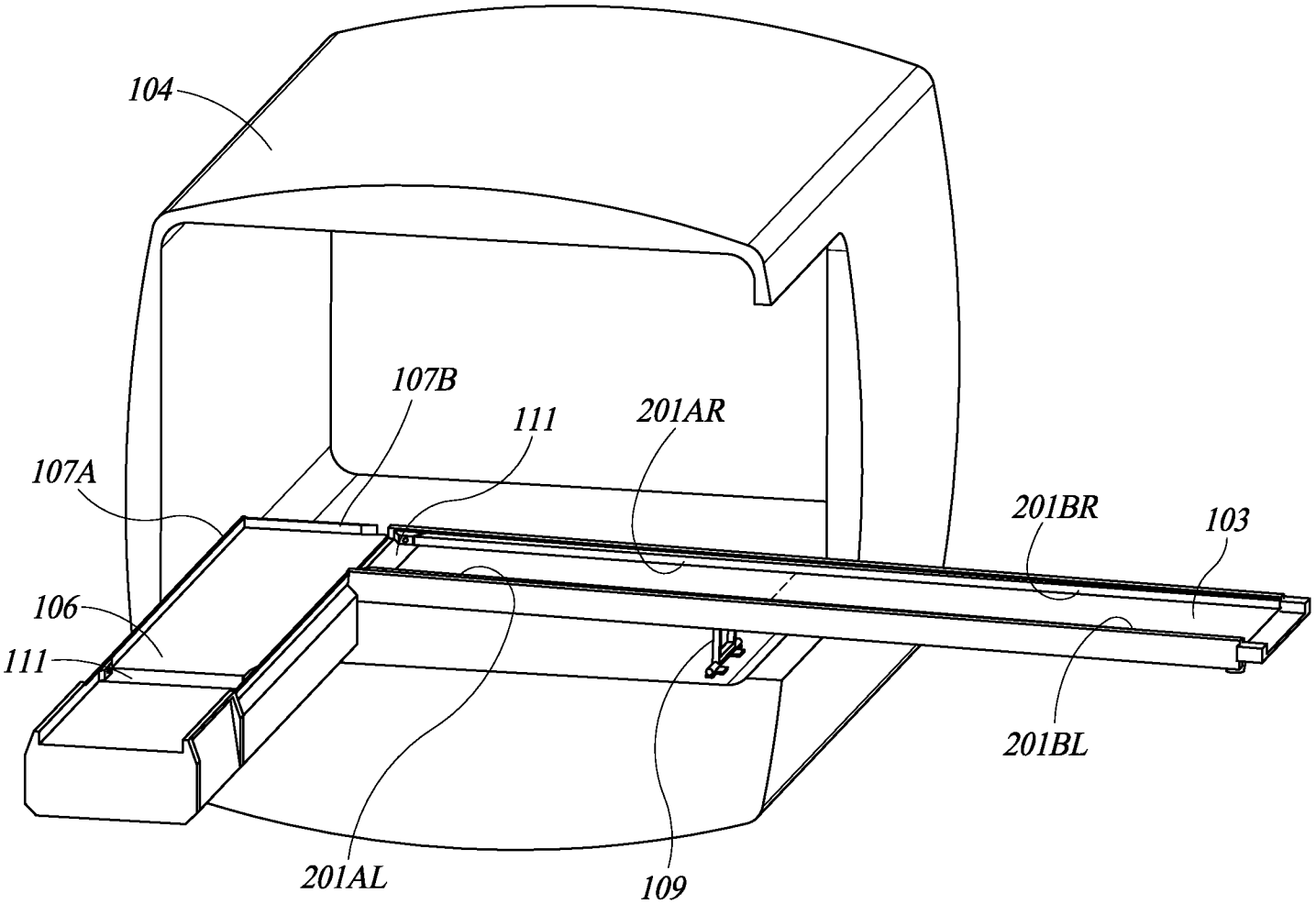
FIG. 1F illustrates a leveling structure under a ramp structure used to level the ramp.

FIG. 1F illustrates a leveling structure under a ramp structure used to level the ramp. As briefly explained in connection with FIG. 1E, at this point, the ramp structure 103 is substantially parallel to the inner floor surface 1200 of the emergency vehicle 104. Accordingly, the heavy lifting part from the medical assistant 120 is done and the medical assistant 120 only needs to shift the base member 130 to the final position in the patient bed structure 106. The patient bed structure 106 includes a first safe wall 107A and a second safe wall 107B adjacent to the first safe wall 107A. This wall serves the purpose of avoiding the moveable base member 130 from rolling off the corner of the ramp.

Figure 1G:
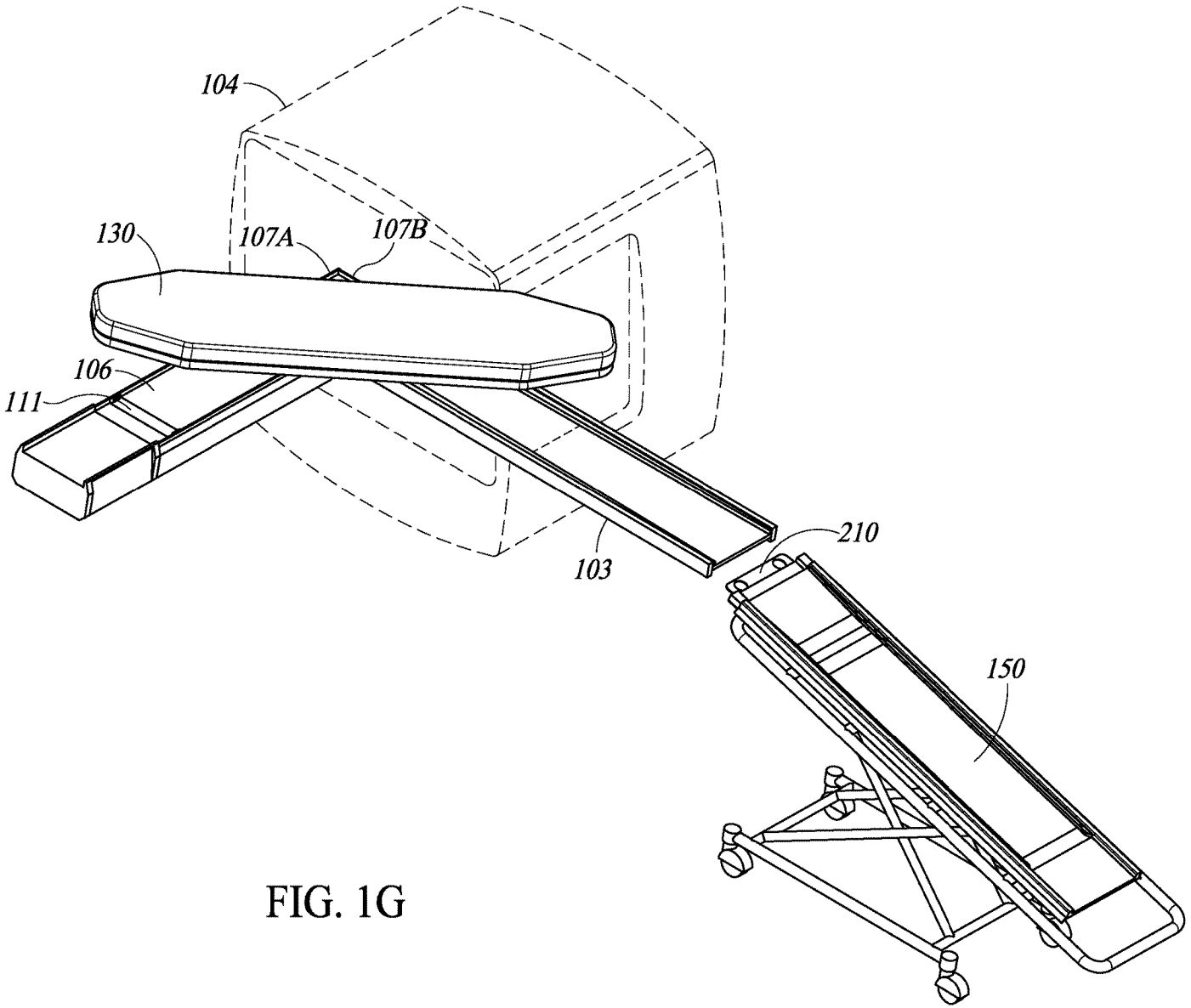
FIG. 1G illustrates a movement of a moveable base member sliding pass the corner of a patient bed structure and into the emergency medical vehicle shown in FIG. 1A.

FIG. 1G illustrates a movement of a moveable base member sliding pass the corner of the patient bed structure and into the emergency medical vehicle shown in FIG. 1A. As shown, the medical assistant 120 needs to move the moveable base member 130 around the corner of the patient bed structure 106. However, as mentioned, the moveable base member 130 may roll off the corner during the attempt to work around the corner. The first safe wall 107A and the second safe wall 107B ensures that the moveable base member 130 safely transitions its way to the final position within the patient bed structure 106.

Figure 1H:
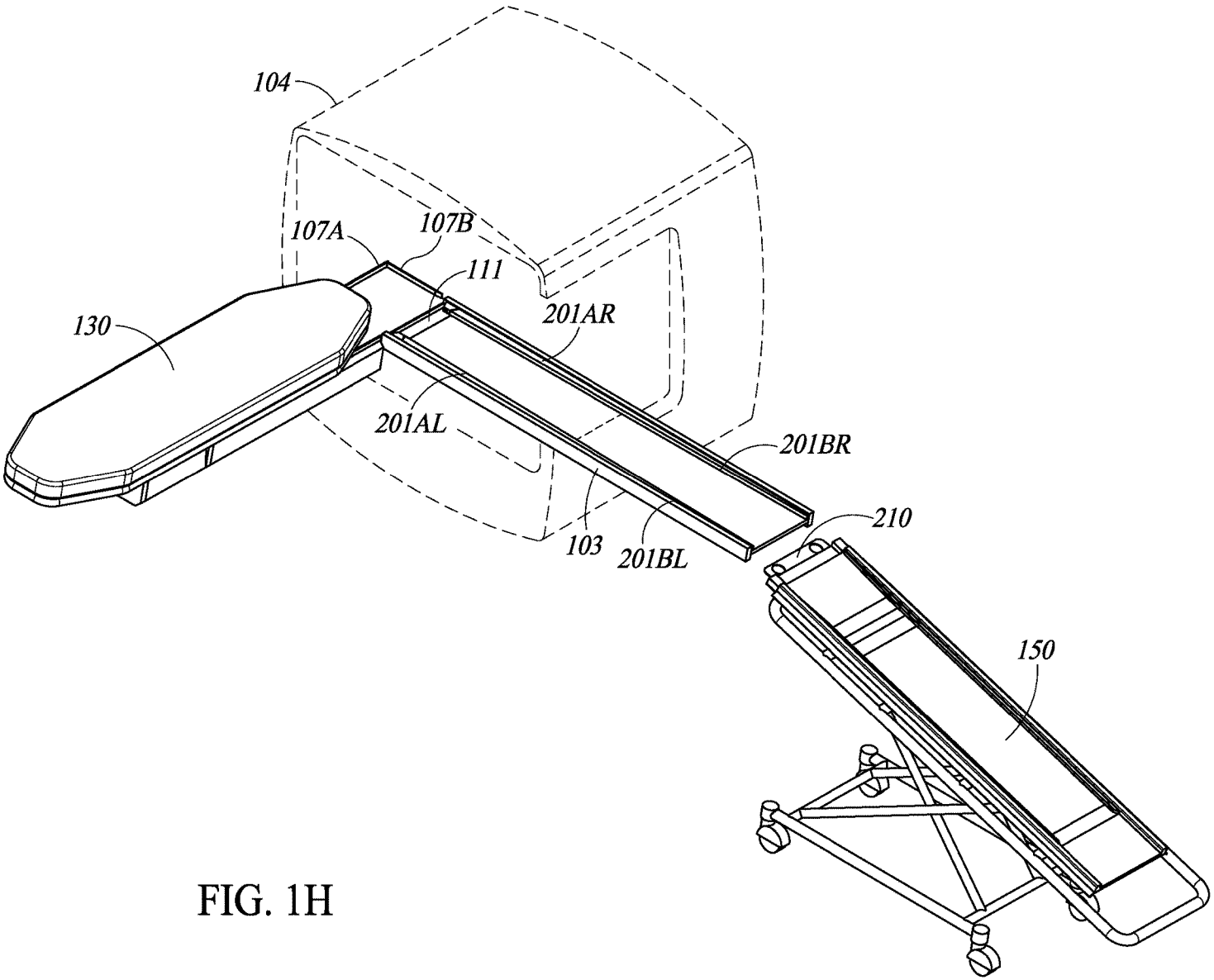
FIG. 1H illustrates a final position of a moveable base member after it is securely docked into the emergency medical vehicle.

FIG. 1H illustrates a final position of a moveable base member after it is securely docked into the emergency medical vehicle. Once the moveable base member 130 is locked and securely fixated to the patient bed structure 106, the ramp structure 103 is detached from the patient bed structure 106 and unfolded for later use.

Figure 1I:
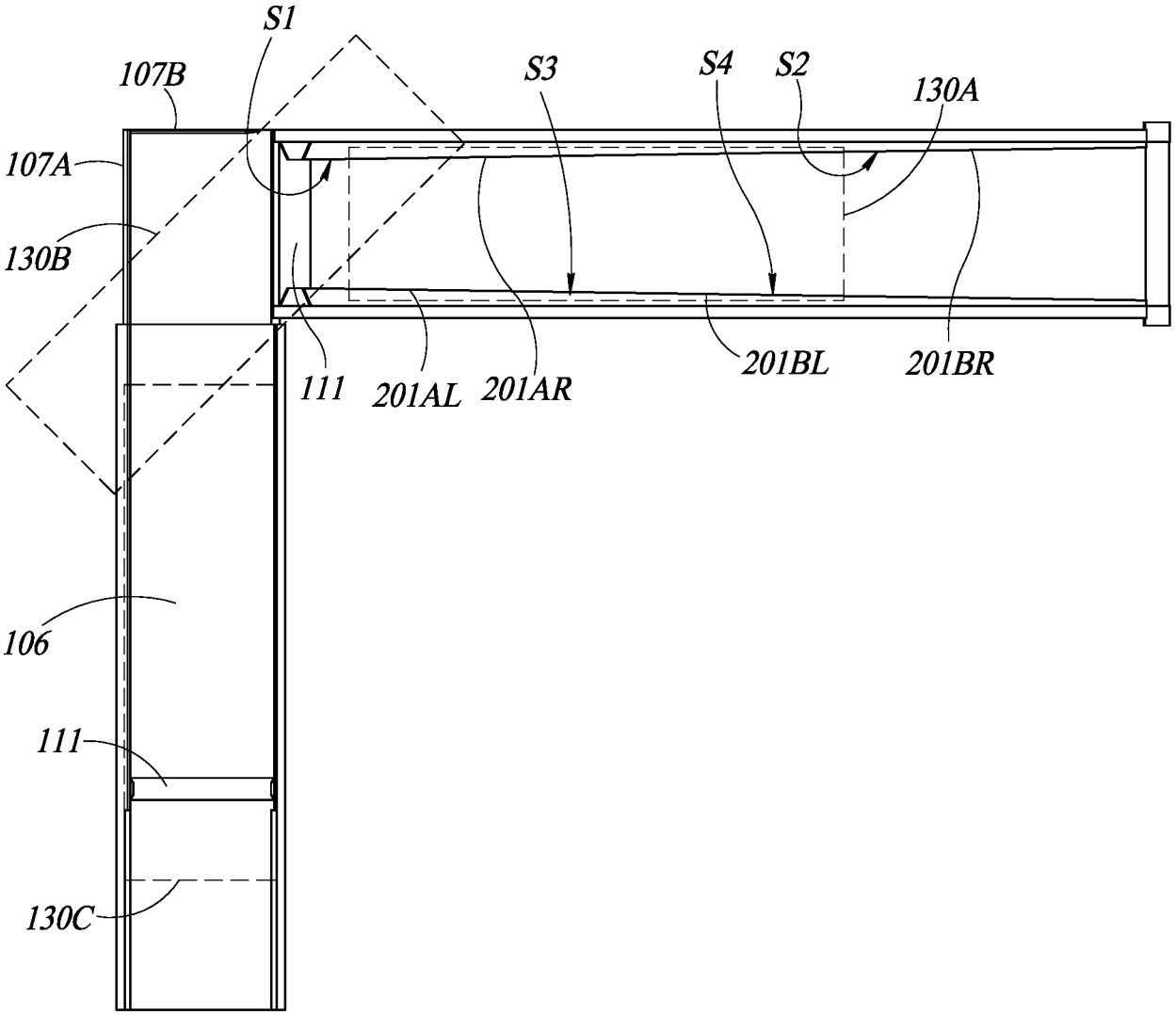
FIG. 1I illustrates a top view of the movement of a moveable base member from a patient transporting device to an emergency medical vehicle shown in FIG. 1A.

FIG. 1I illustrates a top view of the movement of a moveable base member from a patient transporting device to an emergency medical vehicle shown in FIG. 1A. The moveable base member 130 moves up the ramp and is positioned at a first position 130A. This position corresponds to either FIG. 1D or FIG. 1E. The moveable base member 130 is then rotated near the corner and is positioned at a second position 130B. This position corresponds to FIG. 1G. Here, as previously mentioned, because of the first safe wall 107A and the second safe wall 107B, the moveable base member 130 can safely work around the corner and rotate its position without the danger of the base member 130 or the patient on top of the base member 130 falling off the ramp. Once the moveable base member 130 completes its 90 degrees rotation, the base member 130 is securely placed on the patient bed structure 106 using an interlocking mechanism 111 at a third position 130C. This position corresponds to FIG. 1H.

The first left sidewall 201AL and the first right sidewall 201AR is provided on the first portion 103A (or the upper portion) of the ramp structure 103. The upper portion of the ramp structure 103 is closer and is in contact with the patient bed structure 106. The first left sidewall 201AL has an outer sidewall surface S1 and the first right sidewall 201AR which is located in the opposite side of the first left sidewall 201AL has an outer sidewall surface S3 that is facing the outer sidewall surface S1.

The second left sidewall 201BL and the second right sidewall 201BR is provided on the second portion 103B (or the lower portion) of the ramp structure 103. The lower portion of the ramp structure 103 makes contact with the docking plate 210 of the pathway member 150. The second left sidewall 201BL has an outer sidewall surface S4 and the second right sidewall 201BR which is located in the opposite side of the second left sidewall 201BL has an outer sidewall surface S2 that is facing the outer sidewall surface S4. As shown, the left sidewall as a whole has a tapered shape where the thickness of the sidewalls reduce as it goes to the lower portion of the ramp structure 103. This is shown from the top view of FIG. 1I. The right sidewall as a whole also has a tapered shape and the thickness gradually decreases from the upper portion to the lower portion of the ramp.

In order to facilitate the smooth movement of the base member 130 along the ramp, the outer sidewall surface S1 is substantially coplanar with the outer sidewall surface S2 and the outer sidewall surface S3 is substantially coplanar with the outer sidewall surface S4.

Figure 2A:
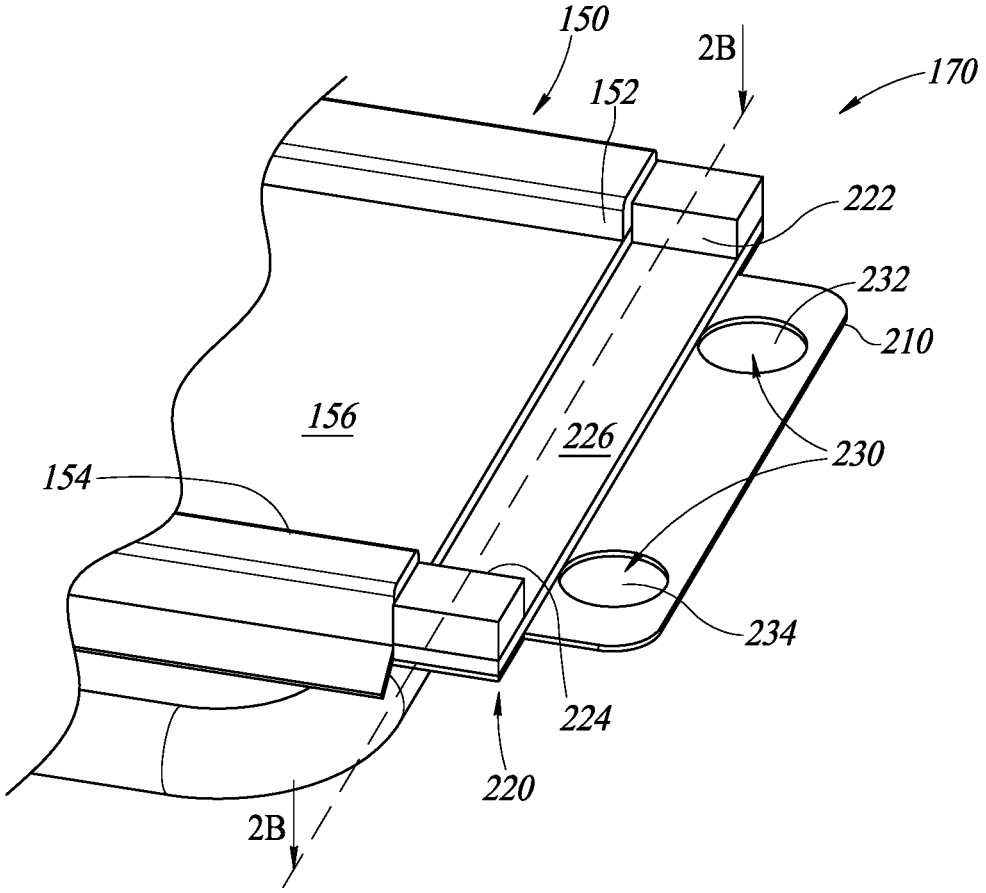
FIG. 2A is an isometric view of a docking member adjacent to a pathway member according to one or more embodiments of the present disclosure.
Figure 2B:
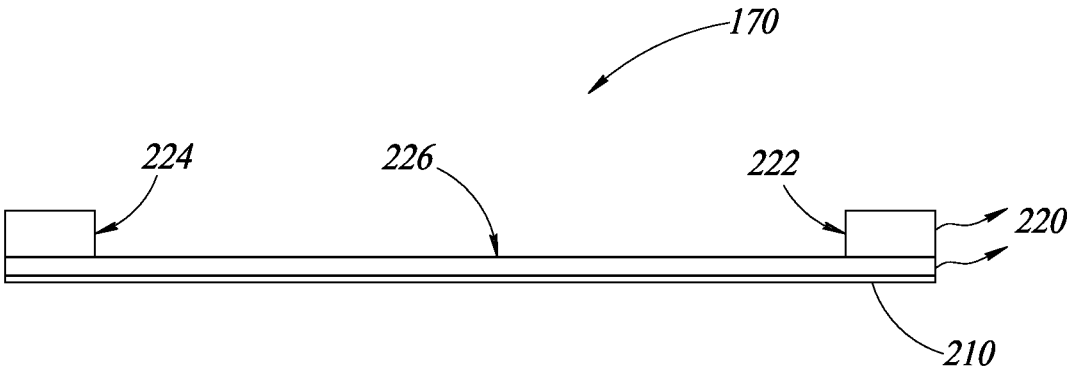
FIG. 2B is a cross-sectional view along lines 2B-2B of a docking member according to one or more embodiments of the present disclosure.
Figure 2C:
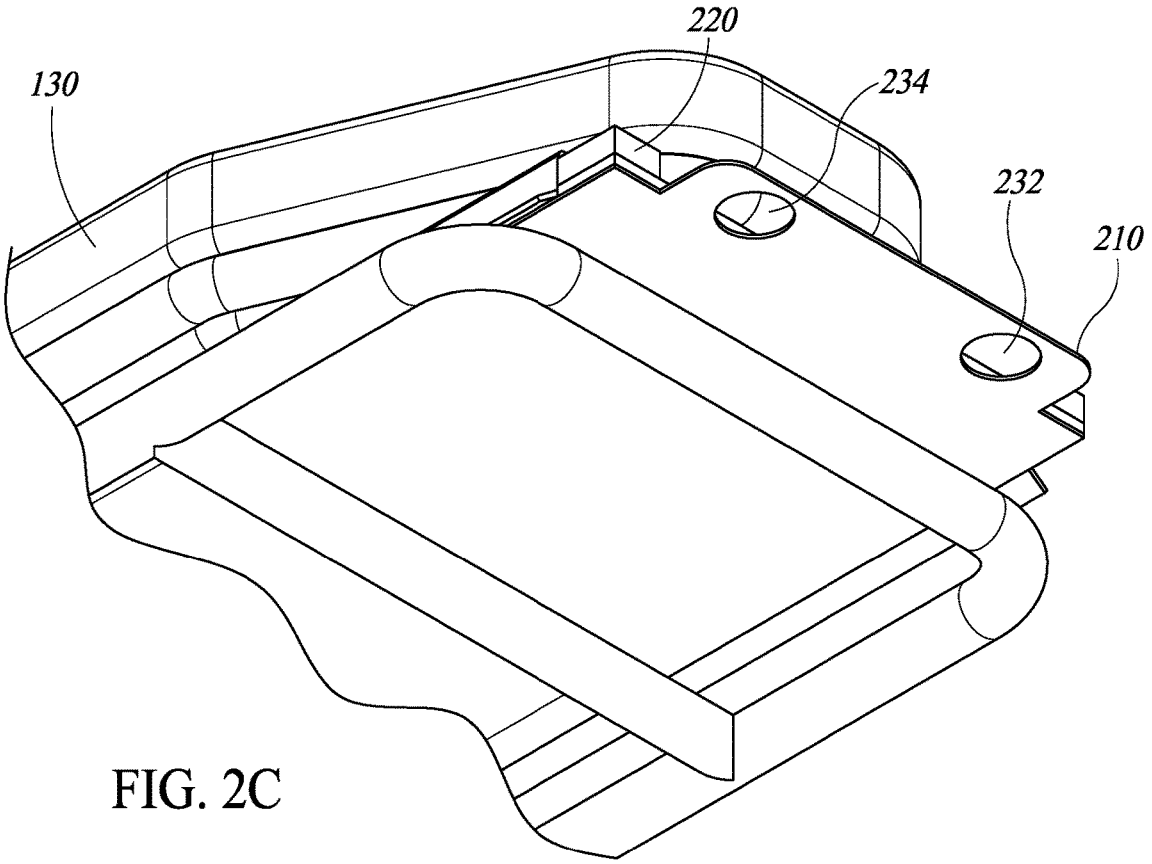
FIG. 2C is an isometric bottom view of a docking member according to one or more embodiments of the present disclosure.

FIG. 2A is an isometric view of a docking member 170 adjacent to a pathway member 150 according to one or more embodiments of the present disclosure. FIG. 2B is a cross-sectional view along lines 2B-2B of a docking member 170 according to one or more embodiments of the present disclosure. FIG. 2C is an isometric view bottom view of a docking member 170 according to one or more embodiments of the present disclosure.

In FIG. 2A, the docking member 170 including a docking plate 210 and a connecting member 220 positioned on the docking plate 210 is shown. The docking plate 210 has one or more openings 230. In some embodiments, the docking plate 210 may be implemented using a stainless steel plate with holes or openings thereon. The connecting member 220 is spaced apart from the one or more openings 230 so as to not overlap with the one or more openings 230. In some embodiments, the openings 230 extend through the docking plate 210. The openings 230 include a first opening 232 and a second opening 234. The first opening 232 and the second opening 234 is positioned in a location to fit and mate with a protruded portion of the receiving portion 102 of the emergency vehicle 104 which will be further described in detail later on. The openings 230 may extend all the way into the docking plate 210 to connect to the other side of the docking plate 210 as shown in FIG. 2A. In other embodiments, the openings 230 may extend half way or to some other extent not extending all the way into the docking plate 210. The depth, size, shape, dimension, pattern of the openings 230 may vary depending on the depth, size, shape, dimension, pattern of the corresponding portion in the receiving portion 102 that the docking member 170 mates or docks into.

The connecting member 220 is on the docking plate 210. The connecting member 220 is adjacent to the pathway member 150. In some embodiments, the docking member 170 abuts the pathway member 150. When the docking member 170, in operation, docks and mates with the receiving portion 102, the connecting member 220 provides an intermediary pathway that connects the pathway member 150 with the receiving portion 102 of the emergency vehicle 104. Once the pathway is established, the base member 130 having thereon the patient 110 may slidably move from the patient transporting device 100 to the emergency vehicle 104. This is advantageous in several aspects. By slidably moving the base member 130 carrying the patient 110 into the emergency vehicle 104 obviates the need of lifting the patient 110 to a different bed, bedplate, tray, or table in the emergency vehicle 104. This is further beneficial to the patient 110 because the patient 110 may not be in a condition to move his/her body, neck, head, leg, or any other part of the patient 110 due to an injury, and trying to lift the patient 110 out of the base member 130 and loading the patient 110 into the vehicle 104 may cause additional injuries. The docking member 170 is also beneficial in that it does not require much force to move the base member 130. That is, moving the base member 130 from the patient transporting device 100 to the emergency vehicle 104 could be done with very few personnel because the patient 110 lying down on the base member 130 does not have to be hand carried to the emergency vehicle 104 (e.g., the moveable base member 130 may just slidably be moved by the medical assistant 120 along the established pathway; see FIG. 1). These and other advantages will be readily appreciated by a person of ordinary skill in the art based on the description provided herein.

In one or more embodiments, as shown in FIG. 2B, the connecting member 220 has a first sidewall 222 and a second sidewall 224 and a supporting plane 226 between the first sidewall 222 and the second sidewall 224. The supporting plane 226 is substantially coplanar with a bottom surface (i.e., path portion 156; see FIG. 2A) of the pathway member 150. The supporting plane 226 provides a smooth movement transition of the base member 130 from the path portion 156 of the pathway member 150 to the receiving portion 102 of the emergency vehicle 104.

In some embodiments, the connecting member 220 and the docking plate 210 are a single structure that is integrally formed. In other embodiments, the connecting member 220 and the docking plate 210 may be separate structures that can be attached to each other.

The pathway member 150 includes a first side frame 152, a second side frame 154 facing the first side frame 152. A path portion 156 is positioned between the first side frame 152 and the second side frame 154. As described above, the path portion 156 is substantially coplanar with the supporting plane 226 of the docking member 170. A first end of the path portion 156 abuts the first side frame 152 and a second end of the path portion 156 opposite of the first end abuts the second side frame 154. In one embodiment, the path portion 156 has a substantially planar top surface. In one or more embodiments, the first sidewall 222 of the docking member 170 is substantially coplanar with the first side frame 152 of the pathway member 150, and the second sidewall 224 of the docking member 170 is substantially coplanar with the second side frame 154 of the pathway member 150 at a location that abuts the connecting member 220 so that the movable base member 130 may smoothly move from the pathway member 150 across the connecting member 220 of the docking member 170 to the receiving portion 102 of the emergency vehicle 104.

As previously described, the tracks or trenches cut into the pathway member 150 are sized to receive the outwardly projected portions from the bottom of the base member 130. The outwardly projected portions are suitably shaped for providing a sliding and inter-fitting pathway for the moveable base member 130 on the pathway member 150.

In some embodiments, the docking member 170 may be a standalone component that may be removably attached to and detached from the patient transporting device 100. That is, during use, the docking member 170 may be affixed to the pathway member 150. In embodiments where the pathway member 150 and the docking member 170 are attached to each other, the pathway member 150 and the docking member 170 may be spaced apart from each other. However, this space will not impede the smooth movement of the base member 130 along the pathway member 150 and the docking member 170. In further embodiments, the pathway member 150 may be modified in a way that incorporates the features of the docking member 170 in a single structure of the pathway member 150. In embodiments where the pathway member 150 and the docking member 170 is formed integrally, there may be no area spaced apart between the pathway member 150 and the docking member 170.

FIG. 2C shows the docking plate 210 extending beneath the supporting plane 226 of the docking member 170 and the path portion 156 of the pathway member 150. The docking plate 210 is affixed to the bottom surfaces of the supporting plane 226 and the pathway member 150 to firmly stabilize the docking member 170 and the pathway member 150 during the movement of the moveable base member 130.

Figure 2D:
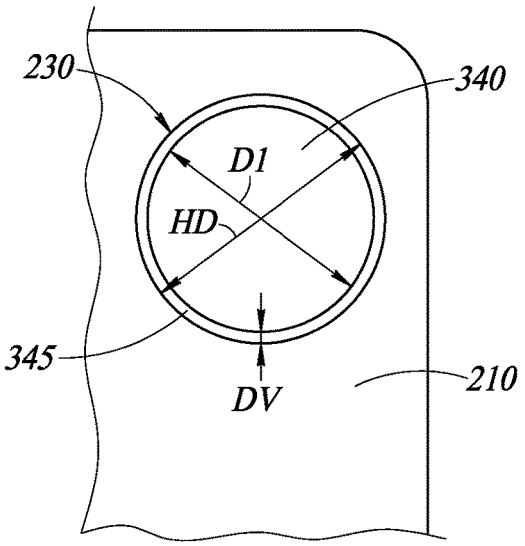
FIG. 2D is an enlarged view of a first opening of a docking plate with a protruding portion filled inside the first opening.

FIG. 2D is an enlarged view of a first opening of a docking plate with a protruding portion filled inside the first opening.

The protruded portions 340 are placed within the apertures or holes or openings 230 of the docking plate 210. The diameter of one protruded portion 340 is $D_1$. The diameter of one opening 230 is HD. A space 345 exists between an inner sidewall of the opening 230 and an outer sidewall of the protruded portion 340 (to be precise, an outer sidewall of the second portion 344 of the protruded portion 340). When the protruded portion 340 is placed exactly in the center of the hole, a gap having a distance DV is uniform along the circumference of the protruded portion 340. That is, in this case, the following relationship is established: $DV=HD/2-D_1/2$.

In a preferred embodiment, the distance of the gap DV is less than 10% of the diameter HD of the opening 230 and greater than about 2% of the diameter HD of the opening 230. In one embodiment, the preferred distance or gap DV is about 4% to 5% of the diameter HD of the opening 230. For example, if the diameter HD of the opening 230 is 1.5 inches (about 3.80 cm), the preferred distance DV for that embodiment is in the range of 0.07 to 0.06 inches (about 1/16 of inch or in the range of 0.177 to 0.152 cm). In a preferred embodiment, the opening 230 is about 1.5 to 1.6 inches (3.8 to 4 cm) and the distance DV is in the range of 4% to 6%, and preferably less than 5% and greater than 3% of the diameter of 230.

Figure 6A:
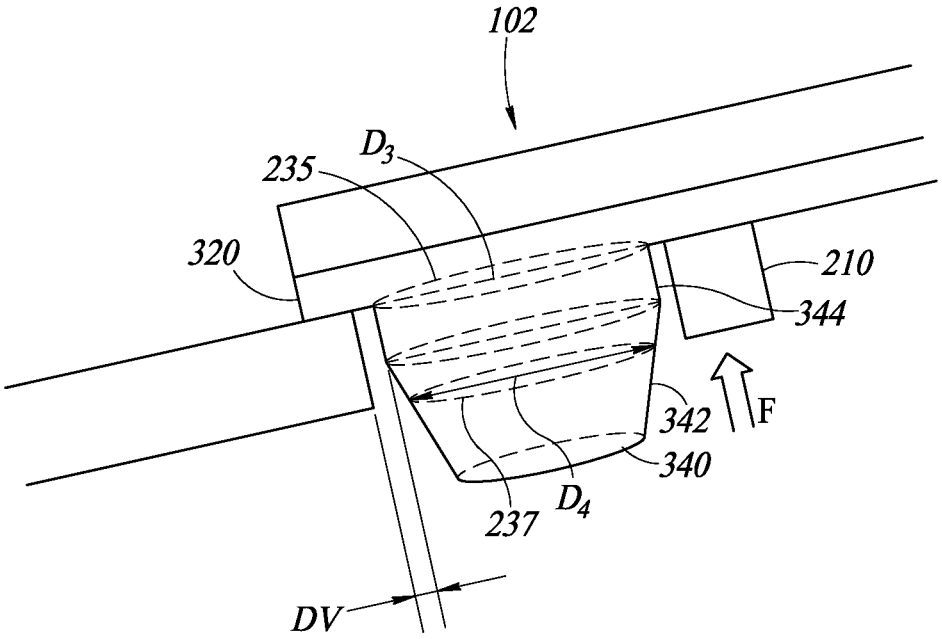
FIG. 6A shows a registered position of the openings of the docking member to the protruded portions of the receiving portion according to another embodiment of the present disclosure.
Figure 6B:
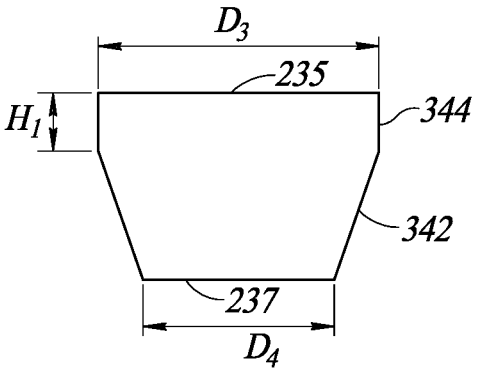
FIG. 6B is an enlarged side view of one of the openings according to the embodiment of FIG. 6A.
Figure 6C:
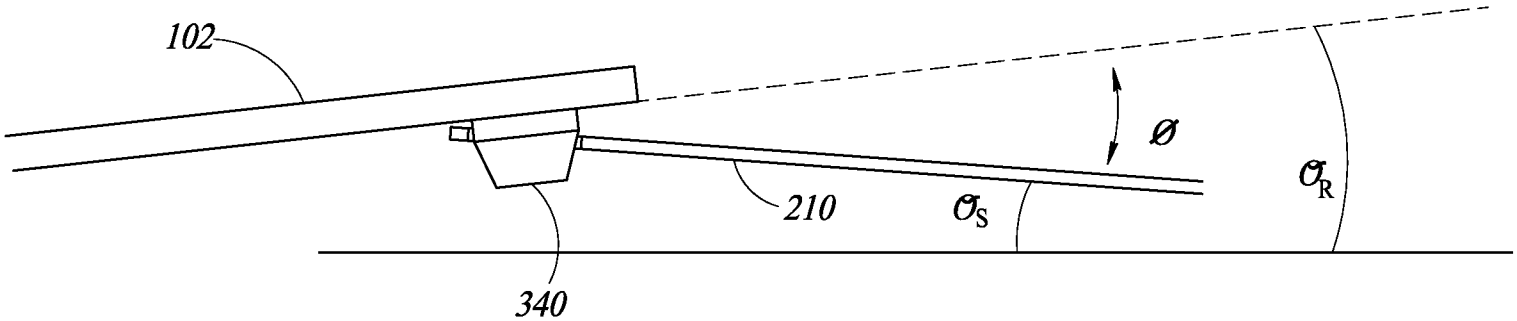
FIG. 6C is a cross-sectional view of the location where the protruded portions slidably move within the openings as shown in FIG. 1D.

The importance of having a distance DV that is greater than about 2% of the diameter HD of the opening 230 is to have sufficient range or enough play for the ramp structure 103 to articulate (as shown in FIG. 6C). A number of test have been done and it was found that a complete snug fit impedes the process of registering into a sufficiently locked position and also prevents it from having sufficient play when the ramp is articulated. For example, when the medical assistant 120 first starts the mating and matching process, it is beneficial to have space to let the ramps 150 and 103 bend back and forth with respect to each other. As such, the space created by distance DV is deliberately done in order to provide room for movement inside the aperture 230.

Figure 2E:
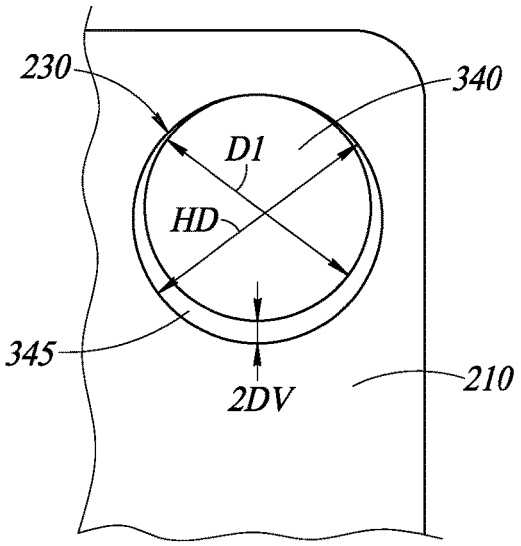
FIG. 2E is an enlarged view of a first opening of a docking plate with a protruding portion shifted along one side within the first opening.

FIG. 2E is an enlarged view of a first opening of a docking plate with a protruding portion shifted along one side within the first opening. As shown, here, the protruded portion 340 is rammed up tight to one side of the opening 230. This will occurs the ramp 103 is lifted to a new angle to move the patient into the plane. As the ramp 103 is raised, the shaft 340 will move within the opening 230 and yet it will remain connected to the ramp 150. If the diameter is of the shaft 340 is not at least 2% smaller than the diameter of the opening 230, there will not be sufficient play for the ramp 103 to be properly raised. As the protruded portion 340 is rammed up tight to one side of the opening 230, the distance of the gap 345 becomes 2DV at one side, and thus is greater compared to the distance DV shown in FIG. 2D. This is very beneficial therefore in both the mating of the two ramps and then for their relative movement at during loading of the patient into the aircraft. Accordingly, the shaft 340 can move within the hole. For example, the distance between the shaft 340 and the edge of the opening 230 of FIG. 2E will be 2DV, about twice as large as the distance DV of FIG. 2D.

Figure 3A:
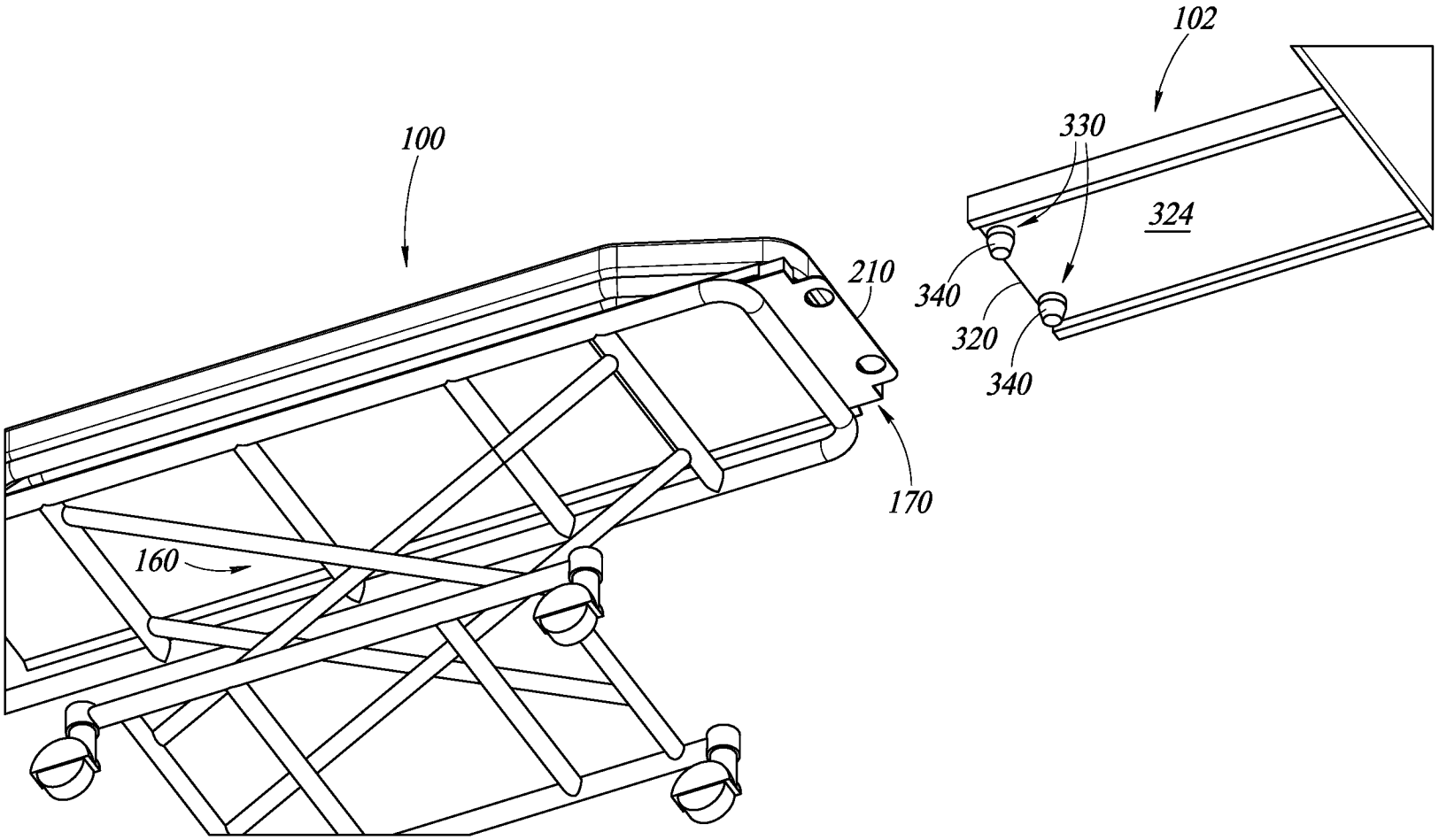
FIG. 3A is an isometric bottom view of a receiving portion of the emergency vehicle having protruding portions and a docking member of a patient transporting device according to one or more embodiments of the present disclosure.
Figure 3B:
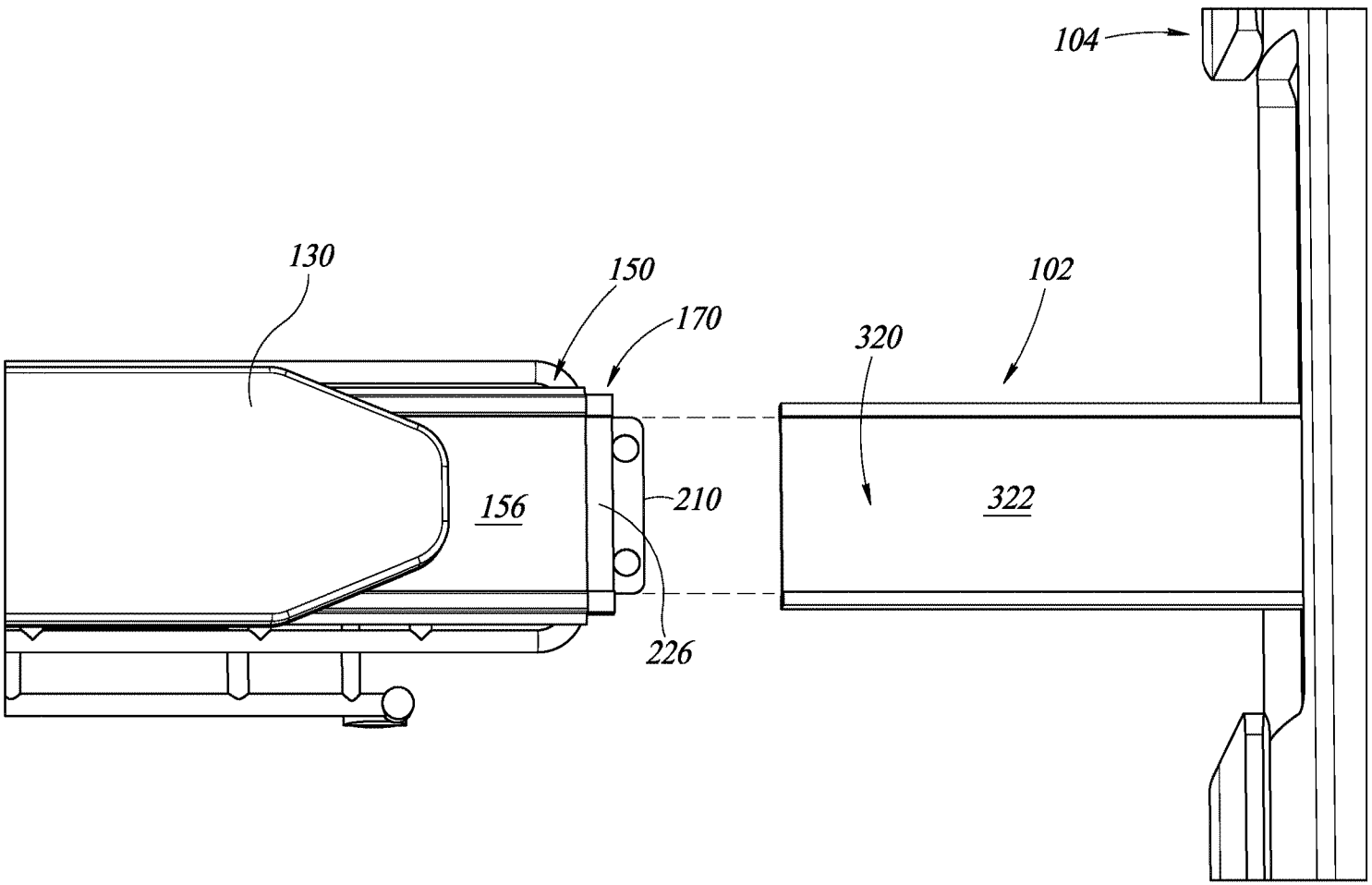
FIG. 3B is a top plan view of a receiving portion of the emergency vehicle and a docking member of a patient transporting device according to one or more embodiments of the present disclosure.
Figure 3C:
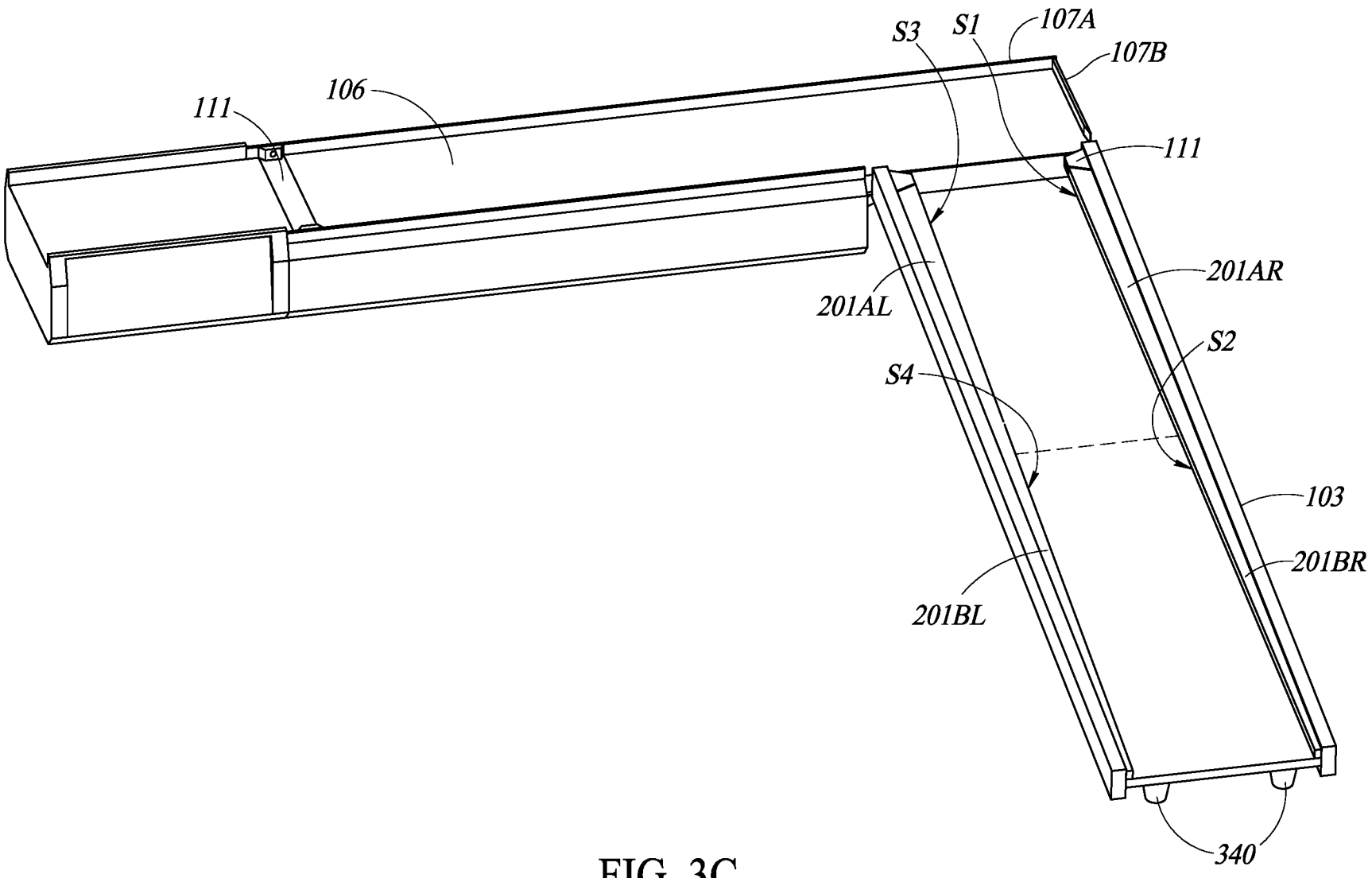
FIG. 3C is a perspective view of a connection formed between an emergency vehicle and a patient transporting device.

As described and shown in FIGS. 2D and 2E, FIGS. 2D and 2E are showing the outermost diameter of the protruded portion 340. Namely, the diameter of the second portion 344 of the protruded portion 340. FIG. 3A is an isometric bottom view of a receiving portion 102 of the emergency vehicle 104 having protruding portions 340 and a docking member 170 of a patient transporting device 100 according to one or more embodiments of the present disclosure. FIG. 3B is a top plan view of a receiving portion 102 of the emergency vehicle 104 and a docking member 170 of a patient transporting device 100 according to one or more embodiments of the present disclosure.

In one or more embodiments, a receiving portion 102 of the patient loading system includes a loading path 320 having a first surface 322 and a second surface 324 opposite of the first surface 322 (see FIG. 3A for the second surface 324 and FIG. 3B for the first surface 322). In FIG. 3A, the first surface 322 of the loading path 320 is not shown as this figure shows a bottom perspective view of the receiving portion 102 of the emergency vehicle 104. However, FIG. 3B shows first surface 322 of the loading path 320. On the second surface 324, a receiving member 330 is positioned on the second surface 324.

The receiving portion 102 includes a receiving member 330 that is positioned close to the end of the loading path 320 so that it can easily dock with the openings 230 of the docking member 170. When the receiving member 330 and the openings 230 of the docking member 170 semi-lock with each other, the movable base member 130 moves along the first surface 322 of the loading path 320 and into the emergency vehicle 104.

Figure 4A:
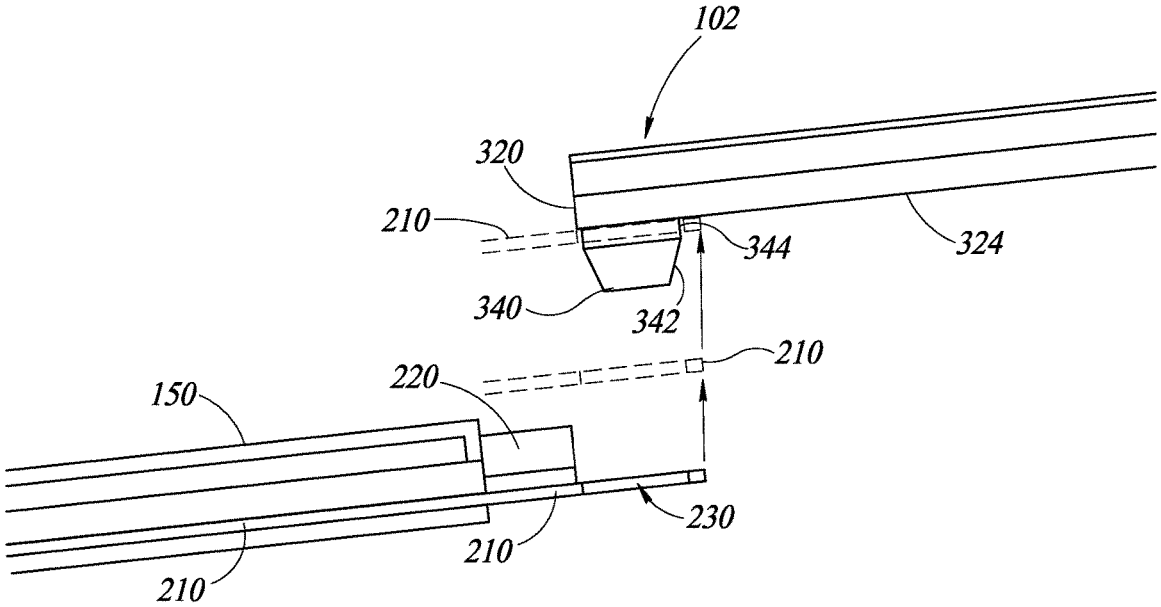
FIG. 4A shows the process of a docking member moving into position to insert openings within a docking plate into protruded portions of a receiving portion.
Figure 4B:
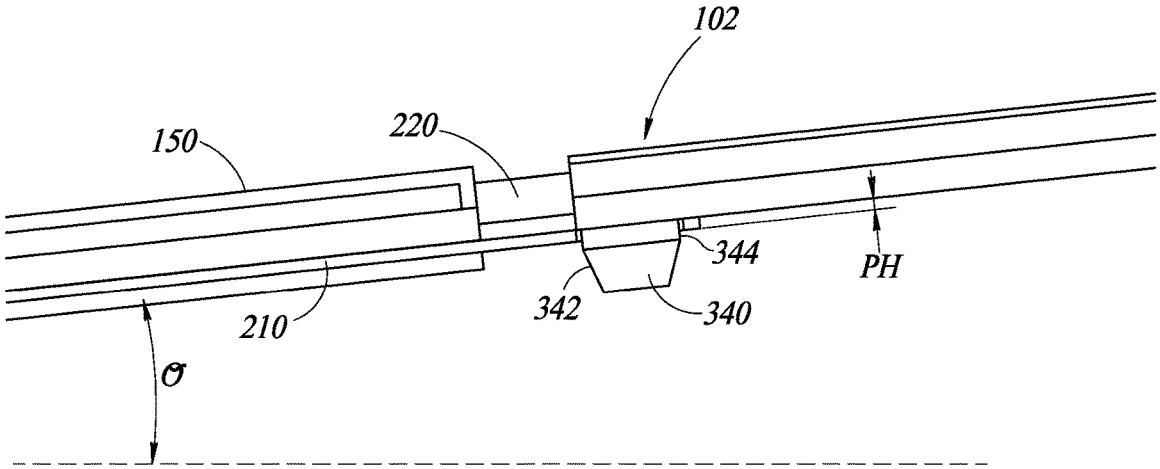
FIG. 4B shows the docking member docked into the receiving portion of the emergency vehicle.

In some embodiments, the receiving member 330 includes one or more protruding portions 340 on the second surface 324. The one or more protruding portions 340 have dimensions (e.g., width, length, height, etc.), sizes, shapes, patterns that correspond to dimensions, sizes, shapes and patterns of the one or more openings 230 of the docking member 170 so that the openings 230 can accommodate for the protruding portions 340 to be inserted into the openings 230. The one or more protruding portions 340 extend away from the second surface 324. The receiving member 330 may have various shapes as described above (e.g., protruding portions 340). In some embodiments, the protruding portions 340 have a shape of a conical frustum that has a trapezoid cross-section. However, in other embodiments, the protruding portions 340 may have a shape of a right cylinder, oblique cylinder, truncated cylinder, right cone, oblique cone, frustum, or any other shape. The cross-sectional shapes of the protruding portions 340 may have other shapes than those listed above. For example, in the figures shown, the protruding portions 340 are drawn to have a tapered pin-like shape. The cross-section of the protruding portions 340 are also shown in FIGS. 4A and 4B. The openings 230 may have corresponding shapes, sizes, dimensions, patterns so that the various protruding portions 340 can be fitted into the openings 230. In one or more embodiments, due to the protruding portions 340 having a tapered pin-like shape, they are easily able to fit into the openings 230. This will be detailed in connection with FIGS. 4A and 4B. In some embodiments, the protruding portions 340 is made of metal, stainless steel, or the like. The protruding portions 340 are fixated at the bottom of the lower ramp structure 103.

During operation, the lift assembly 160 lifts the pathway member 150 having thereon the moveable base member 130 and the docking member 170 and tilts the pathway member 150 and the docking member 170 to dock the one or more openings 230 within the docking plate 210 to the one or more protruding portions 340 of the receiving member 330 at the selected angle. In one or more embodiments, the selected angle forms an extended longitudinal bridge that has a substantially coplanar surface between the path portion 156 of the pathway member 150, the supporting plane 226 of the docking member 170, and the first surface 322 of the loading path 320 of the receiving portion 102. This extended bridge allows the moveable base member 130 to move from the patient transporting device 100 to the emergency vehicle 104.

FIG. 4A shows the process of a docking member 170 moving into position to insert openings 230 within a docking plate 210 into protruded portions 340 of a receiving portion 102. FIG. 4B shows the docking member 170 docked into the receiving portion 102 of the emergency vehicle 104. FIGS. 4A and 4B show a side view.

In FIG. 4A, a lift assembly 160 (not shown) lifts the pathway member 150 and the docking member 170 having the connecting member 220 and the docking plate 210, and tilts the members 150, 170 as necessary to roughly fit the openings 230 in the docking plate 210 to the protruded portions 340 of the receiving portion 102. For example, the lift assembly 160 may lift the members 150, 170 at a first position that is close to the protruded portions 340. Next, the lift assembly 160 may further lift or tilt the docking member 170 so that the openings 230 within the docking plate 210 fits into the protruded portions 340. When the respective openings 230 are mated with the respective protruded portions 340, the docking plate 210 is in direct contact with the second surface 324 of the loading path 320 of the receiving portion 102.

Here, the cross-section of the protruded portion 340 is shown. In this embodiment, the protruded portion 340 has a tapered pin-like shape. The protruded portion 340 includes a first portion 342 and a second portion 344. The first portion 342 has an isosceles cross-section and the second portion 344 has a rectangle cross-section as shown in FIGS. 4A and 4B. Because the dimensions (e.g., length or radius of the circular cross-section) of the first portion 342 of the protruded portion 340 gradually increases as it goes towards the second portion 342 of the protruded portion 340, the size of the openings 230 does not have to have a snug fit with the first portion 342 of the protruded portion 340. And the gap DV (shown in FIGS. 5A and 6A) provides the locking tolerance in order to have solid locking but also gives sufficient movement within the opening 230. That is, the gap DV is intentionally left to have sufficiently snug fit that holds in place as well as sufficient looseness so that it may bent or tilt within the opening 230 (shown in FIGS. 1D, 1E, and 6C)

This allows the medical assistant 120 to roughly match the location of the protruded portion 340 with openings 230 in the docking plate 210 to quickly and swiftly dock the pathway member 150 where the patient is fastened to. As the openings 230 passes through the first portion 342 and contacts the second portion 344 of the protruded portion 340, the second portion 344 assists to reduce or minimize lateral movement.

Lift assembly 160 may include an electric motor to easily elevate the patient transporting device 100 and easily tilt (e.g., decreasing or increasing the angle of inclination) the docking member 170 for docking to the receiving portion 102 of the emergency vehicle 104. For example, increasing the angle of inclination of the pathway member 150 also raises the moveable base member 130 carried thereon as well as the docking member 170 affixed to the pathway member 150.

However, as mentioned before, this process of fitting in the openings 230 to the protruded portions 340 can be accomplished manually by the medical assistant 120.

FIG. 4B shows that the openings 230 within the docking plate 210 are sufficiently fit into the protruded portions 340. This prevents the lateral movement of the docking plate 210 with respect to the receiving portion 102. When the docking member 170 and the receiving portion 102 is at a registered position (or a predetermined position), an extended bridge is established with the pathway member 150 and the docking member 170 of the patient transporting device 100 and the receiving portion 102 of the emergency vehicle 104. The extended bridge formed at a selected angle θ has a substantially coplanar surface so that the patient 110 lying down on the base member 130 may easily be loaded to the emergency vehicle 104.

Figure 5A:
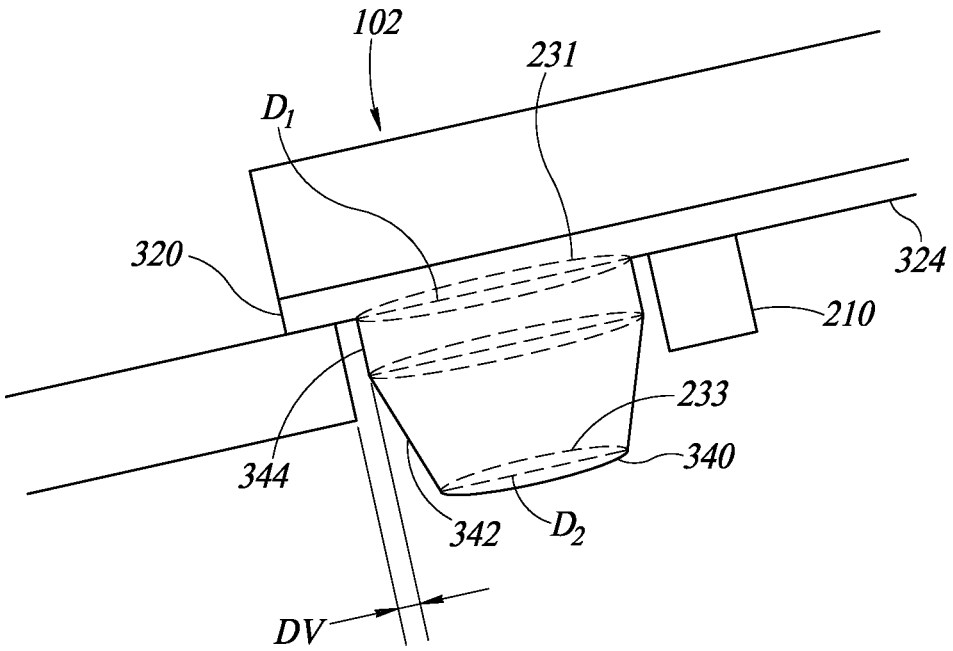
FIG. 5A shows a registered position of the openings of the docking member to the protruded portions of the receiving portion according to one embodiment of the present disclosure.

In this embodiment, the thickness PH of the docking plate 210 is thinner than the thickness or the height H1 of the second portion 344 of the protruded portion 340. FIGS. 5A and 6A which is another modification of embodiment shown in FIG. 4B show that the thickness PH of the docking plate 210 is thicker than the height H1 of the second portion 344 of the protruded portion 340.

Figure 5B:
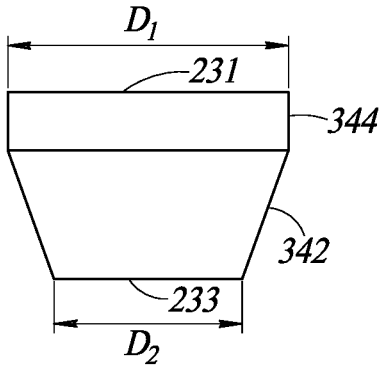
FIG. 5B is an enlarged side view of one of the openings of the docking member according to the embodiment of FIG. 5A.

FIG. 5A shows a registered position of the openings 230 of the docking member 170 to the protruded portions 340 of the receiving portion 102 according to one embodiment of the present disclosure. FIG. 5B is an enlarged side view of one of the openings 230 of the docking member according to the embodiment of FIG. 5A.

In FIG. 5A, a second surface 324 of the loading path 320 contacts the docking plate 210. The cross-section of the protruded portion 340 has an inversed trapezoid shape. The openings 230 have a circular hole through which the protruded portions 340 extend into during use. The opening 230 may have a circular cross-section 231 that has a diameter $D_1$. As shown in FIG. 5B, the opening 230 may have a circular cross-section 233 that has a diameter $D_2$ that is smaller than $D_1$. The diameter $D_1$ of the circular cross-section 231 may be large enough to closely fit to the protruded portion 340. Similarly, the diameter $D_2$ of the circular cross-section 233 may be large enough to closely fit to the mid portion of the protruded portion 340. In some embodiments, diameter $D_1$ of the second portion 344 of the protruded portion 340 is about 1.5 inches. However, other dimensions may be utilized based on the design of the protruded portion 340. The thickness or the height of the docking plate 210 does not necessarily have to be half the thickness or the height of the protruded portion 340. The docking plate 210 may have various thicknesses or heights. For example, the thickness of the height H1 of the second portion 344 may be about 5/16 inches. However, other suitable dimensions may be utilized based on the various designs of the protruded portion 340.

The close fit of the openings 230 with the protruded portions 340 provides a beneficial safety feature. The lift assembly 160 lifts up the docking member 170 and controls the tilt angle to fit the openings 230 to the protruded portions 340. In some embodiments, the openings 230 may have a diameter about 1 and 9/16 inches. However, this is merely an example and other suitable dimensions may be utilized based on the various designs of the openings 230 in the docking plate 210. The lift assembly 160 controls the position of the openings 230 so that the openings 230 move into a registered position over the protruded portions 340. In such position, the close fit of the openings 230 to the protruded portions 340 prevents the docking member 170 from inadvertently being moved to a released position (e.g., the docking member 170 being released from the receiving portion 102 of the emergency vehicle 104). In some embodiments, the thickness of the docking plate 210 may be 3/16 inches. However, other suitable dimensions may be utilized based on the various designs of the docking plate 210. For example, FIG. 5A shows that the thickness (or the height) of the docking plate 210 being greater than the height $H_1$ of the second portion 344 of the protruded portion 340 (see FIG. 6B which also shows the height $H_1$ of the second portion 344).

With reference to FIG. 5A, the protruded portions 340 receive the openings 230 of the docking plate 210. This close and sufficient fit prevents substantial vertical, transverse, or twisting motion of the docking member 170 with respect to the loading path 320 or the receiving portion 102. However, because there are some gap DV between the second portion 344 of the protruded portion 340 and the inner sidewall of the aperture of the docking plate 210, there is sufficient room to move back and forth and articulate as shown in FIG. 2E. This ability provided by the gap DV allows the docking plate 210 to smoothly detach from the ramp structure 103 as shown in FIGS. 1D and 1E.

As shown in FIGS. 5A and 5B, there is no additional locking or interlocking mechanism employed besides having a docking plate 210 with an opening 230 that can fit the protruded portion 340. That is, the docking plate 210 couples with the protruded portions 340 through the openings 230 but it is not additionally locked or interlocked using a locking pin or any other suitable locking means. This allows the docking member 170 to easily engage and disengage with the receiving portion 102 of the emergency vehicle 104. It requires minimum effort and can quickly and easily attach to or detach from the receiving portion 102 of the vehicle 104. This also results in the patient transporting device 100 being able to be inserted quickly and easily onto the receiving portion 102 of the vehicle 104 during loading of the patient 110 and, just as quickly and easily, be released for unloading of the patient 110 at the medical facility.

FIG. 6A shows a registered position of the openings 230 of the docking member 170 to the protruded portions 340 of the receiving portion 102 according to another embodiment of the present disclosure. FIG. 6B is an enlarged side view of one of the openings 230 according to the embodiment of FIG. 6A.

Similarly, the docking plate 210 having the openings 230 may be applied force F into a direction of the arrow (see FIG. 6A) so that openings 230 maintain contact with the second surface 324 of the loading path 320 and surrounds contours of the protruded portion 340. This prevents the lateral movement of the docking plate 210 as a diameter $D_3$ of the circular cross-section 235 of the opening 230 substantially fits over the protruded portion 340 that is in direct contact with the second surface 324 of the loading path 320. Because the force F is applied against the loading path 320, the docking plate 210 cannot be released from the registered position or the docked position without unhooking the opening 230 from the protruded portion 340, which would require that the force F be unapplied and become unengaged from the registered position. The force F applied in the direction of the arrow towards the loading path 320 prevents inadvertent release, separation and establishes the longitudinal extended path between the loading path 320 and the supporting plane 226 and the path portion. In order to release the docking plate 210 from the loading path 320, the force F can be simply unapplied and the docking plate 210 will automatically releasably undock from the registered position due to the weight of the docking member 170 (e.g., gravitational force). In some embodiments, the control of the docking member 170 into the registered position can be done manually by the medical assistant 120.

In some embodiments, this force F may be provided from the lift assembly 160 that includes an electric motor. As explained previously, this electric motor of the lift assembly 160 is used to easily elevate the patient transporting device 100 and easily tilt the docking member 170 for docking to the receiving portion 102 of the emergency vehicle 104. For example, when the lift assembly 160 operates to increase the angle of inclination of the docking plate 210 of the docking member 170, the force F may be applied in the direction as shown in the arrow.

In FIG. 6A, a second surface 324 of the loading path 320 contacts the docking plate 210. The cross-section of the protruded portion 340 has an inversed trapezoid shape. The openings 230 have a circular hole through which the protruded portions 340 extends into during use. The opening 230 may have a circular cross-section 235 that has a diameter $D_3$. As shown in FIG. 6B, the opening 230 may have a circular cross-section 237 that has a diameter $D_3$ that is larger than the diameter $D_4$ of the protruded portion 340 at the cross-section 237. That is, while opening 230 at cross-section 235 is just large enough to closely fit to the protruded portion 340 at cross-section 235, the opening 230 at cross-section 237 is much large and loosely fits to the protruded portion 340 which has a smaller diameter $D_4$ at cross-section 237.

However, due to the force F applied upward against the loading path 320, the docking member 170 securely fixed at the registered position. In such position, similar to the embodiments shown in FIGS. 5A and 5B, the openings 230 to the protruded portions 340 prevents the docking member 170 from inadvertently being moved to a released position (e.g., the docking member 170 being released from the receiving portion 102 of the emergency vehicle 104).

As shown in FIGS. 6A and 6B, there is no additional locking or interlocking mechanism employed besides having a docking plate 210 with an opening 230 that can fit the protruded portion 340 and an applied force F from the patient transporting device 100 to the loading path 320. This force F in combination with the opening 230, provides a coupling effect of the docking plate 210 with the protruded portions 340 without the use of any locking or interlocking mechanisms. This allows the docking member 170 to easily engage and disengage with the receiving portion 102 of the emergency vehicle 104 and results in the patient transporting device 100 being able to be inserted quickly and easily onto the receiving portion 102 of the vehicle 104 during loading of the patient 110 and, just as quickly and easily, be released for unloading of the patient 110 at the medical facility.

The term "dock," "fit," "couple," or "mate" is used to express that the openings 230 of the docking member 170 does not necessarily "lock" or "interlock" with the protruded portion of the receiving portion 102.

Figure 7A:
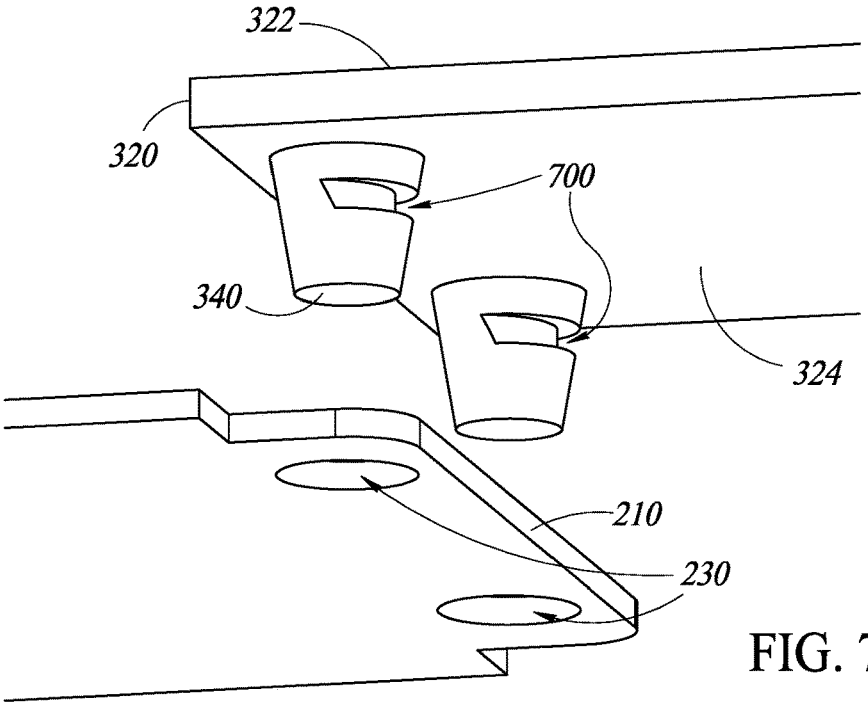
FIGS. 7A, 7B, 7C show a protruded portions of the receiving portion having a recess and the openings of the docking member locking into the recess according to another embodiment of the present disclosure.
Figure 7B:
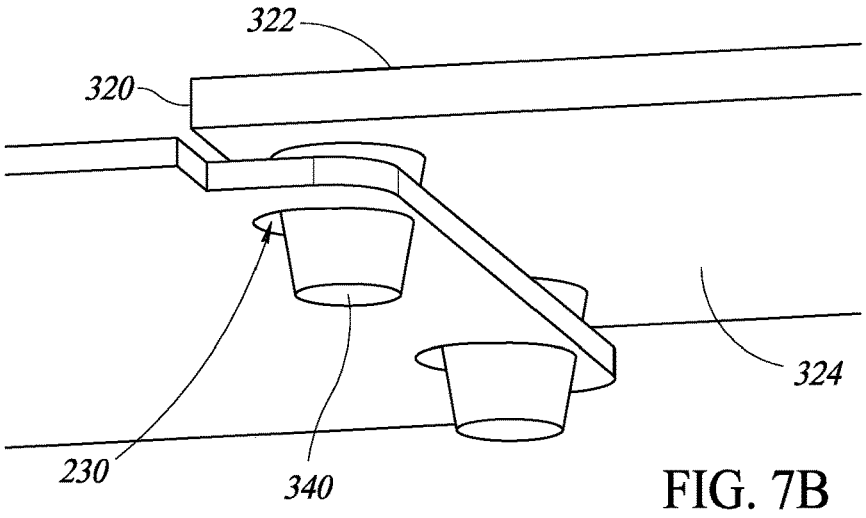
Figure 7C:
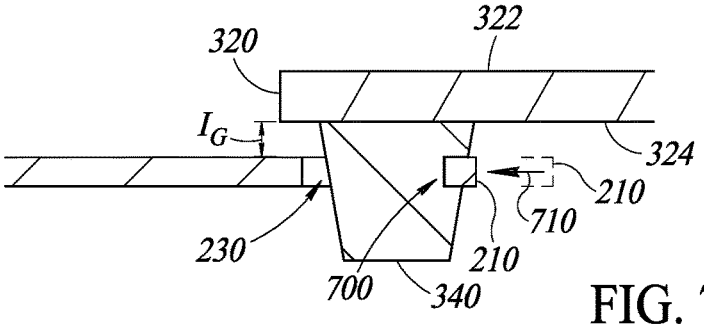

FIG. 6C is a cross-sectional view of the location where the protruded portions move within the openings as shown in FIG. 1D. When the moveable base member 130 passes and moves up the ramp structure 103 from the pathway member 150, the lift assembly of the patient transporting device further lifts up the receiving portion 102. The receiving portion 102 is lifted up so that the moveable base member 130 is now substantially parallel with the inner floor surface 1200 of the emergency vehicle 104. Here, angle $\theta_R$ is the angle that the receiving portion 102 forms with respect to the horizon or the ground, and angle $\theta_S$ is the angle that the docking plate 210 forms with respect to the horizon or the ground, and angle ø is angle $\theta_R$ minus angle $\theta_S$. The lift assembly is capable of moving up and down and adjust angle ø. Further, angle $\theta_S$ of the docking plate 210 may change while the opening 230 of the docking plate 210 is still connected to the protruded portion 340. The distance DV that is the space between the protruded portion 340 and opening 230 permits this angle to change. It is particularly beneficial to have the distance of the diameter of less than 10% and preferably less than 5% of the diameter of the opening 230. Keeping the distance DV at about or less than 5% permits the two ramps 103 and 150 to docket with each other firm hold together. If the distance DV is greater than 10%, than a solid mating and linking of the ramps to each other is more difficult and their might be too much play in the ramps with respect to each other for the safe transfer of the patient. FIGS. 7A, 7B, 7C show a protruded portions 340 of the receiving portion 102 having a recess 700 and the openings 230 of the docking member 170 locking into the recess 700 according to another embodiment of the present disclosure.

As shown in FIG. 7A, the protruded portion 340 has a recess 700 so that the docking plate 210 can slidably lock into the recess portion 700 through the openings 230. FIG. 7B shows the openings 230 of the docking plate 210 being interlocked with the protruded portions 340 at the location of the recess 700.

In some embodiments, the dimensions, sizes, shapes, and patterns of the openings 230 will have corresponding dimensions, sizes, shapes, and patterns of the recess 700 so that the docking plate 210 can snap into a registered position within the recess 700. In some embodiments, the recess 700 within the protruded portion 340 operates as a locking or interlocking mechanism where it will securably fix the position of the docking plate 210 of the docking member 170 to the protruded portion 340 in the loading path 320.

In FIG. 7C, a docking plate 210 is spaced apart from a second surface 324 of the loading path 320. The distance or the gap IG is between the second surface 324 of the loading path 320 and a top surface of the docking plate 210 where the top surface is opposite and facing the second surface 324. In order to release from the registered position, the docking plate 210 may be forced to a direction opposite to 710.

In one or more embodiments, the distance IG will be compensated in a way that the top surfaces of the path portion 156 of the pathway member 150, the supporting plane 226 of the docking member 170, and the first surface 322 of the loading path 320 of the receiving portion 102 is made substantially coplanar. This substantially coplanar surface may form an extended longitudinal bridge at a selected angle θ that allows the moveable base member 130 to move from the patient transporting device 100 to the emergency vehicle 104.

Figure 8A:
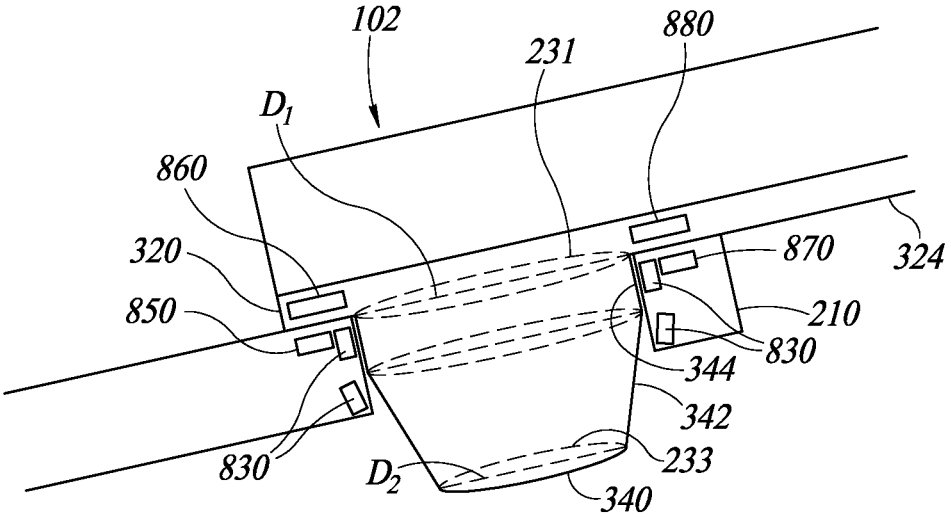
FIG. 8A shows a registered position of the openings of the docking member to the protruded portions of the receiving portion according to another embodiment of the present disclosure.
Figure 8B:
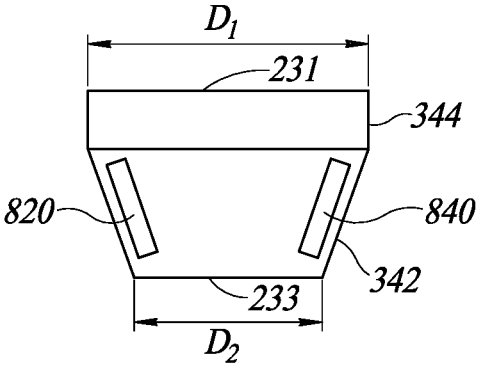
FIG. 8B is an enlarged side view of one of the protruded portions according to the embodiment of FIG. 8A.

FIG. 8A shows a registered position of the openings 230 of the docking member 170 to the protruded portions 340 of the receiving portion 102 according to another embodiment of the present disclosure. FIG. 8B is an enlarged side view of one of the protruded portions 340 according to the embodiment of FIG. 8A.

Instead of applying the force F into a direction of the arrow in FIG. 6A, the docking plate 210 may be attached to the second surface 324 of the loading path 320 using magnetic structures. At a surface of a docking plate 210 adjacent to one lateral side of the opening 230, there may be a first magnetic structure 810 included within said surface of the docking plate 210. At another surface of the docking plate 210 adjacent to another lateral side of the opening 230, there may be a second magnetic structure 830 included within said surface of the docking plate 210. The first and second magnetic structures 810, 830 included within the docking plate 210 may fix the position of the protruded portion 340 within the opening 230. In some cases, the protruded portion 340 may be made of magnetic, or ferromagnetic materials. In cases where the protruded portion 340 does not show any magnetic characteristics, the protruded portions 340 may be inserted to include magnets 820, 840 at opposite or corresponding locations from the first and second magnetic structures 810, 830.

In other embodiments, additional magnetic structures may be included to ensure that the unwanted lateral, vertical, and horizontal movements are prevented. For example, the docking plate 210 may have a third magnetic structure 850 and a fourth magnetic structure 870 in a location that faces the second surface 324 of the loading path 320. In some cases, the loading path 320 may be made of magnetic, or ferromagnetic materials. In cases where the loading path 320 does not show any magnetic characteristics, the loading path 320 may have magnets 860, 880 at opposite or corresponding locations from the third and fourth magnetic structures 860, 880.

In some embodiments, the force F applied by the electric motor of the lift assembly 160 may be additionally applied in combination with the magnetic force generated based on the magnetic structures. In some cases, the magnetic structures incorporated within the vicinity of the openings 230 of the docking plate 210 may suffice.

Other suitable positing fixing means may be utilized beside magnetic structures.

It will be readily appreciated by a person of ordinary skill in the art that these magnetic structures may be applied additionally or alternatively to the other embodiments described within the present disclosure. For example, the magnetic structures can be applied to the embodiments as shown in FIGS. 5A, 5B, 6A, and 6B. Various features described in the embodiments may be combined that results in the patient transporting device 100 being able to be inserted quickly and easily onto the receiving portion 102 of the vehicle 104 during loading of the patient 110 and, just as quickly and easily, be released for unloading from the vehicle 104.

Another aspect of the present disclosure provides a method 900 of transporting a patient 110.

Figure 9:
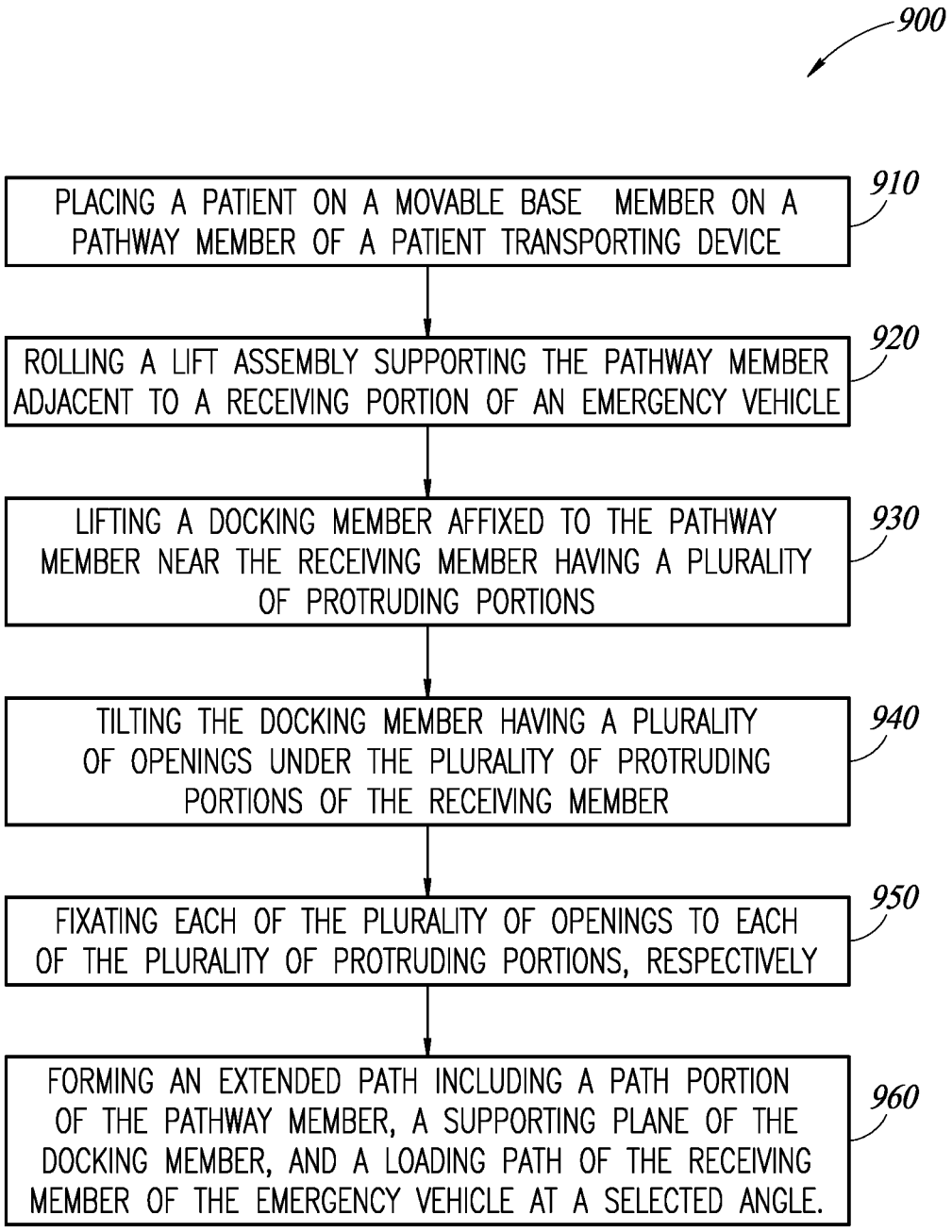
FIG. 9 illustrates a flow chart of a method of docking a docking member of a patient transporting device to an emergency vehicle and loading a patient into the vehicle.

FIG. 9 illustrates a flow chart of a method 900 of docking a docking member 170 of a patient transporting device 100 to an emergency vehicle 104 and loading a patient 110 into the vehicle 104. The method includes at step 910, placing a patient 110 on a movable base member 130 on a pathway member 150 of a patient transporting device 100. At step 920, the method includes rolling a lift assembly 160 supporting the pathway member 150 close to the receiving portion 102 of the emergency vehicle 104. At step 930, the method includes lifting a docking member 170 affixed to the pathway member 150 near a receiving member 330 having a plurality of protruding portions 340. At step 940, the method includes tilting the docking member 170 having a plurality of openings 230 under the plurality of protruding portions 340 of the receiving member 330. At step 950, the method includes fixating or hooking each of the plurality of openings 230 to each of the plurality of protruding portions 340, respectively. At step 960, the method includes forming an extended path including a path portion 156 of the pathway member 150, a supporting plane 226 of the docking member 170, and a loading path 320 of the receiving portion 102 of the emergency vehicle 104 at a selected angle θ.

The step 960 of forming an extended path includes forming top surfaces of the path portion 156, the supporting plane 226, and the loading path 320 to be substantially coplanar to each other.

In some embodiments, the method includes moving the movable base member 130 from the path portion 156 of the pathway member 150 to the loading path 320 of the receiving portion 102 via the supporting plane 226 of the docking member 170 at the selected angle θ.

The step 950 of fixating or hooking each of the plurality of openings 230 to each of the plurality of protruding portions 340, respectively includes docking respective openings 230 to corresponding protruding portions 340, and affixing position of the docking member 170 and the receiving member 330 to form a coplanar surface between the supporting plane 226 of the docking member 170 and the loading path 320 of the receiving portion 102.

In some embodiments, the method also includes releasably disengaging or unhooking the respective openings 230 from the respective protruding portions 340, upon the lift assembly 160 tilting to an angle different from the selected angle θ.

Further aspects of the present disclosure is provided.

One aspect of a patient transporting device 100 for loading to a patient loading vehicle 104 and unloading from the patient loading vehicle 104 includes a movable base member 130. A patient 110 is placed on the movable base member 130. The patient transporting device 100 includes a pathway member 150 configured to provide a path for the movable base member 130. The patient transporting device 100 further includes a docking member 170 positioned adjacent to the pathway member 150. The docking member 170 is configured to mate with a receiving portion 102 of the patient loading vehicle 104.

In operation, the pathway member 150, the docking member 170, and the receiving portion 102 of the patient loading vehicle 104 form a substantially coplanar path for the moveable base member 130 to slidably move from the pathway member 150, the docking member 170, and the receiving portion 102 of the patient loading vehicle 104.

In some embodiments, the docking plate 210 extends beneath the supporting plane 226 of the docking member 170 and the path portion 156 of the pathway member 150, and the docking plate 210 is affixed to the supporting plane 226 and the pathway member 150.

The patient transporting device 100 further includes a lift assembly 160 for supporting the pathway member 150. The lift assembly 160 is configured to elevate the pathway member 150 vertically, and to tilt the pathway member 150 at a selected angle θ (see FIG. 1 and FIG. 4B).

The receiving portion 102 of the patient loading vehicle 104 includes a loading path 320 having a first surface 322 and a second surface 324 opposite to the first surface 322. The receiving portion 102 includes a receiving member 330 on the second surface 324. The movable base member 130, during operation, moves along the first surface 322 of the loading path 320 and into the patient loading vehicle 104.

In some embodiments, the receiving member 330 includes one or more protruding portions 340 on the second surface 324. The one or more protruding portions 340 has dimensions (e.g., width, length, height, etc.), sizes, shapes, and patterns that corresponds to dimensions, sizes, shapes, and patterns of the one or more openings 230 of the docking member 170. The one or more protruding portions 340 extends away from the second surface 324.

In operation, the lift assembly 160 lifts the pathway member 150 having thereon the moveable base member 130 and the docking member 170, and tilts the pathway member 150 and the docking member 170 to dock the one or more openings 230 of the docking plate 210 to the one or more protruding portions 340 of the receiving member 330 at the selected angle θ.

In one or more embodiments, the supporting plane 226 of the docking member, the path portion of the pathway member, and the first surface of the loading path form a substantially coplanar surface at the selected angle with respect to each other and in operation, allows the moveable base member to slidably move along from the pathway member to the loading path of the patient loading vehicle via the docking member.

In some embodiments, the docking member and the pathway member is formed integrally. However, in other embodiments, the docking member may be a separate component and may be removably attached to and detached from the pathway member.

In some embodiments, the pathway member has brake members on each of the first side frame and the second side frame. The brake members are configured to prevent the moveable base member from sliding down from the pathway member at the selected angle.

Figure 10:
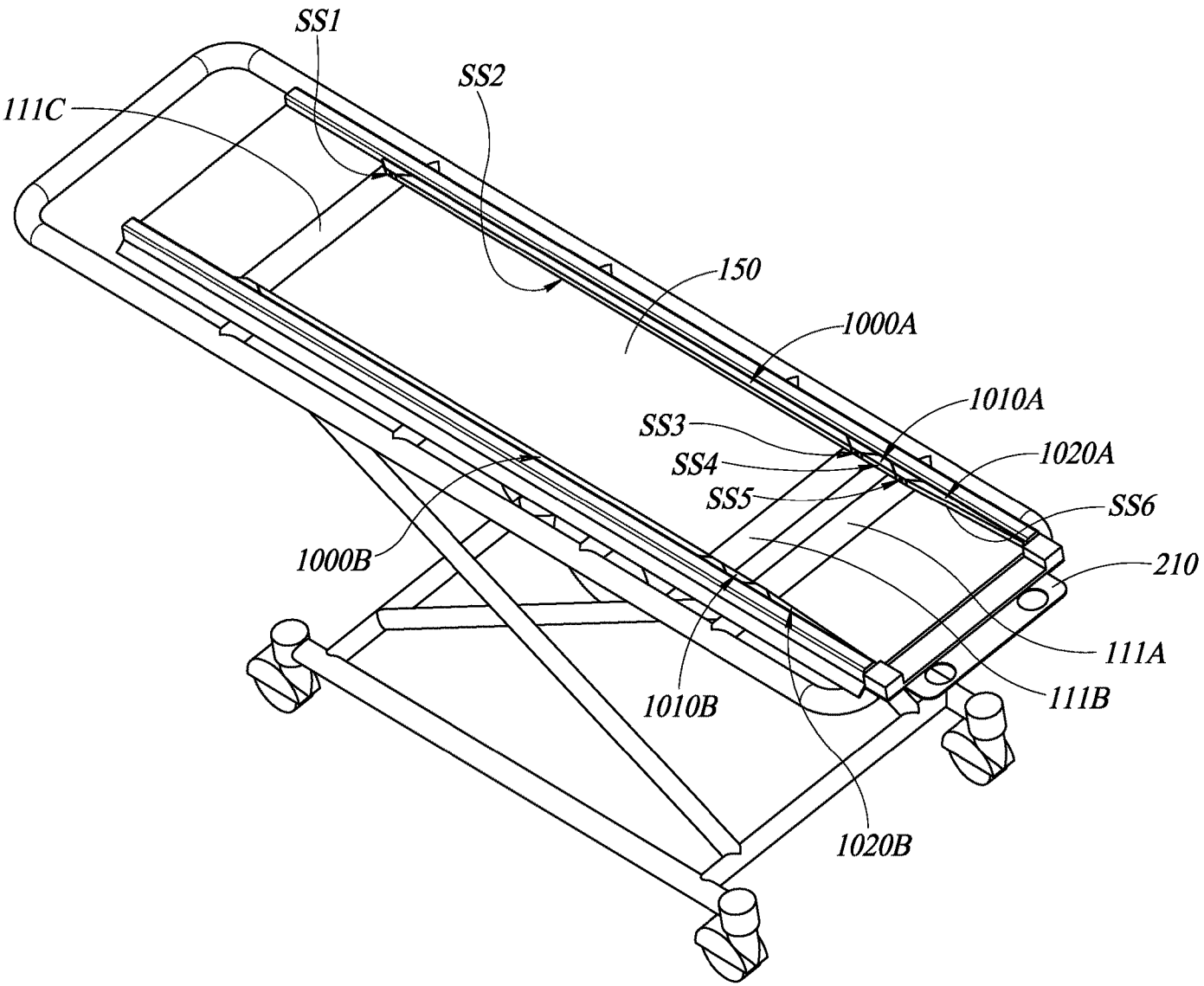
FIG. 10 is a perspective view of a patient transporting device without a moveable base member.

FIG. 10 is a perspective view of a patient transporting device without moveable base member. A pathway member 150 is shown and on the top there are three interlocking mechanisms 111A, 111B, and 111C. The first interlocking mechanism 111A is located the closest to the docking plate 210. The second interlocking mechanism 111B is located between a third interlocking mechanism 111C and the first locking mechanism 111A. The interlocking mechanisms 111A, 111B, and 111C are detailed in connection with FIGS. 11A, 11B, and 11C. When a patient is lying down the moveable base member, the moveable base member either locks with at least one of the first interlocking mechanism 111A or the second interlocking mechanism 111B and interlocks with the third interlocking mechanism 111C. Depending on the height of the patient, the moveable base member may be changed accordingly. If a longer moveable base member is required in order to accommodate the height of the patient, the second interlocking mechanism 111B is disabled and the first interlocking mechanism 111A and the third interlocking mechanism 111C is used. However, if a shorter moveable base member is required in order to accommodate the height of the patient, the first interlocking mechanism 111A is disabled and the second interlocking mechanism 111B and the third interlocking mechanism 111C is used. On the bottom of the moveable base member, a metal tab is provided in order to insert into holes 1110A, 1110B of the interlocking mechanism 111. If the second interlocking mechanism 111B is not disabled in order to accommodate a patient with taller height, when the moveable base member slides passes the second interlocking mechanism 111B, the metal tab will engage with the second interlocking mechanism 111B and will not be able to slide its way up and interlock with the first interlocking mechanism 111A.

The third interlocking mechanism 111C has a side surface SS1, the second interlocking mechanism 111B has a side surface SS3, and the first interlocking mechanism 111A has a side surface SS5. Between the third interlocking mechanism 111C and the second interlocking mechanism 111B, a first sidewall structure 1000A is attached to the inner sidewall of the pathway member 150. The first sidewall structure 1000A has a side surface SS2. Between the first interlocking mechanism 111A and the second interlocking mechanism 111B, a second sidewall structure 1010A is attached to the inner sidewall of the pathway member 150. The second sidewall structure 1010A has a side surface SS4. Between the first interlocking mechanism 111A and the docking plate 210, a third sidewall structure 1020A is attached to the inner sidewall of the pathway member 150. The third sidewall structure 1020A has a side surface SS6.

Same or similar sidewall structures are formed on the opposite side of the pathway member 150. On the other side, between the third interlocking mechanism 111C and the second interlocking mechanism 111B, a fourth sidewall structure 1000B is attached to the opposite inner sidewall of the pathway member 150. Between the first interlocking mechanism 111A and the second interlocking mechanism 111B, a fifth sidewall structure 1010B is attached to the opposite inner sidewall of the pathway member 150. Between the first interlocking mechanism 111A and the docking plate 210, a sixth sidewall structure 1020B is attached to the opposite inner sidewall of the pathway member 150.

As shown, the first sidewall structure 1000A has a tapered structure where the thickness of the sidewall gradually decreases as it approaches the docking plate 210. The second sidewall structure 1010A which is relatively small piece or a strip located between two adjacent locking mechanisms 111A and 111B, also has a tapered structure. The third sidewall structure 1020A also has tapered structure where the thickness of the sidewall gradually decreases as it approaches the docking plate 210. The opposite sidewall structures 1000B, 1010B, 1020B have similar or corresponding tapered structure.

In order to facilitate the smooth movement of the base member 130 along the pathway member 150, the sidewall surfaces SS1, SS2, SS3, SS4, SS5, and SS6 are substantially coplanar with each other.

In some embodiments, the sidewall surfaces SS1, SS3, and SS5 are substantially coplanar with each other and the sidewall surfaces SS2, SS4, and SS6 are substantially coplanar with each other. However, because the sidewall surfaces of SS1, SS3, and SS5 are narrow in dimension, even if these sidewall surfaces of SS1, SS3, and SS5 are not coplanar with sidewall surfaces SS2, SS4, and SS6, they do not impede the smooth and slidable movement of the moveable base member 130 on the pathway member 150.

Figure 11A:
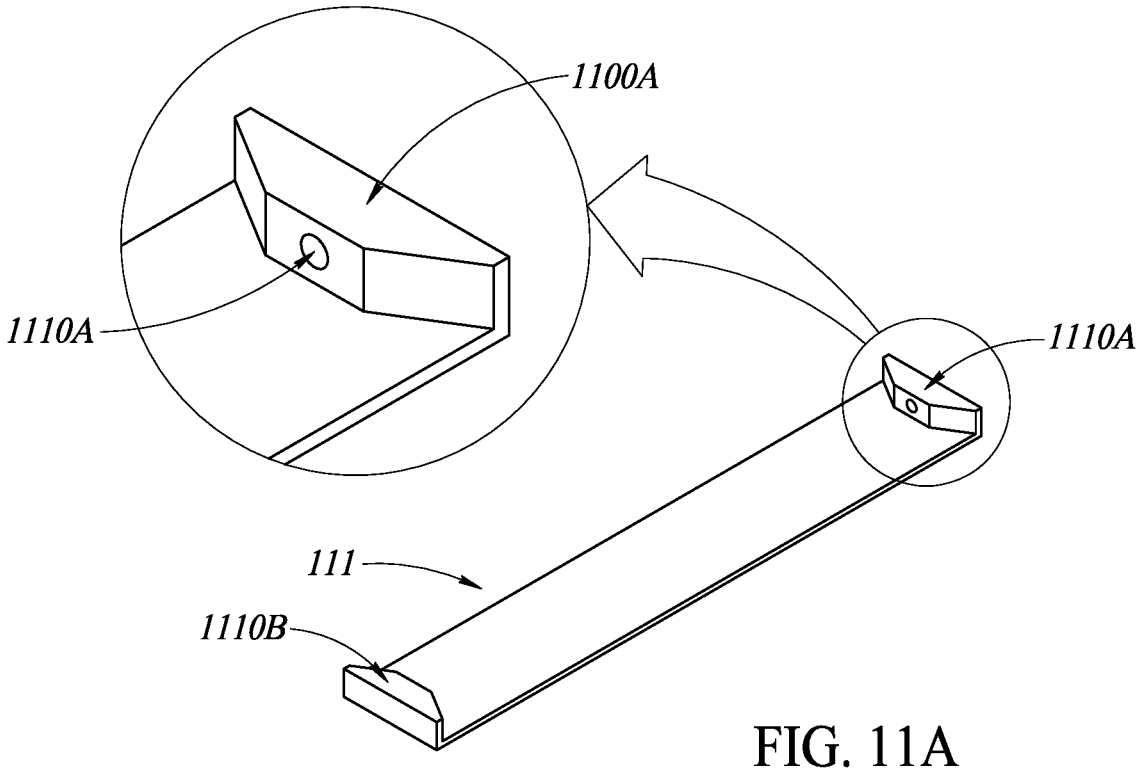
FIG. 11A is a perspective view of an interlocking mechanism.

FIG. 11A is a perspective view of an interlocking mechanism. The interlocking mechanism 111 includes a first metal tab 1110A and a second metal tab 1110B opposite the first metal tab 1110A. The first metal tab 1110A includes an aperture 1110A in the middle to accommodate a metal tab coupled to the moveable base member. The metal tab of the moveable base member may have a circular or cylindrical shape protrudes outwardly and that substantially matches the size of the aperture 1110A of the first metal tab 1110A. Based on pushing a button in the moveable base member, the metal tab of the moveable base member retreats from its protruded position to retract from the aperture 1110A of the first metal tab 1110A. Once the metal tab of the moveable base member retreats from the aperture 1110A, it may slidably move along the pathway member 150 as needed.

Figure 11B:
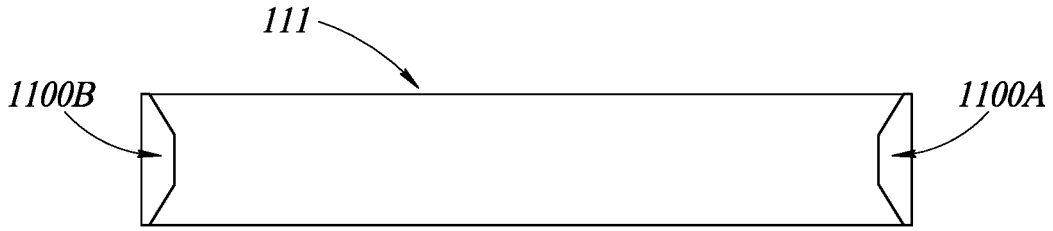
FIG. 11B is a top view of an interlocking mechanism shown in FIG. 11A.

FIG. 11B is a top view of an interlocking mechanism shown in FIG. 11A. The second metal tab 1110B has similar structures as the first metal tab 1110A. That is, the second metal tab 1110B also includes an aperture 1110B as shown in FIG. 11C.

Figure 11C:
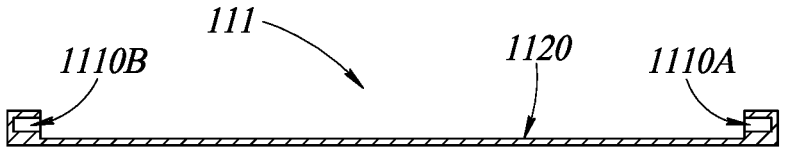
FIG. 11C is a cross-sectional view of an interlocking mechanism shown in FIG. 11A.

FIG. 11C is a cross-sectional view of an interlocking mechanism shown in FIG. 11A. As shown, the first metal tab 1110A and the second metal tab 1110B extend from a top surface of a base member 1120 of the interlocking mechanism 111. Further, the interlocking mechanism 111 including the first metal tab 1110A and the second metal tab 1110B is a single, continuous piece. Just having the metal tabs 1110A, 1110B without the base member 1120 is not rigorous and sustainable for continued medical operations. Accordingly, having a single, continuous, trench-shape structure is beneficial as it is more resilient to abrasion and does not easily detach from the sidewall of the pathway member because it is made of a single piece.

Figure 12A:
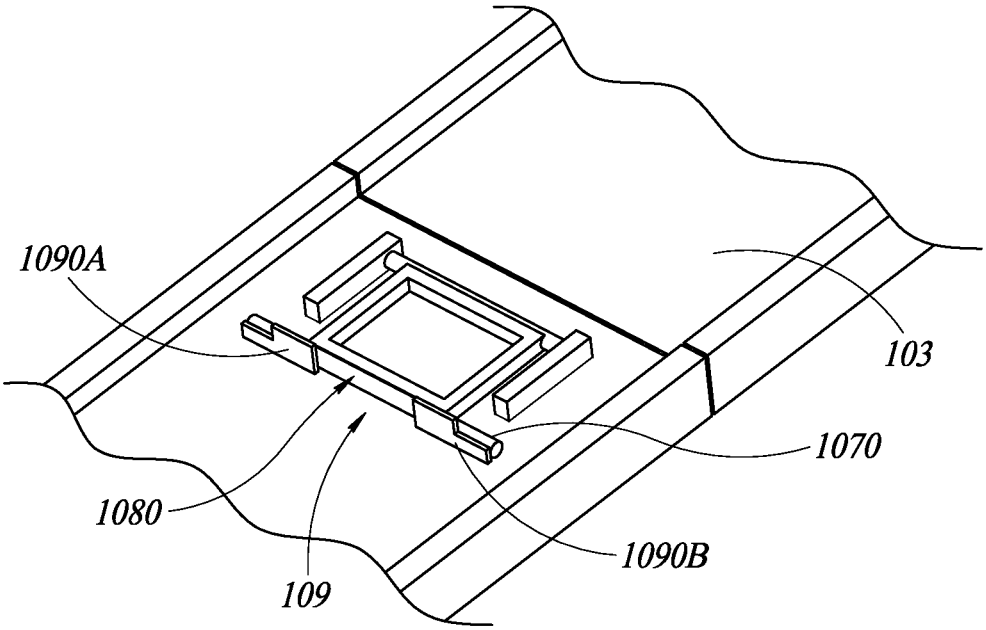
FIG. 12A is a view of a leveling structure folded under a ramp structure.
Figure 12B:
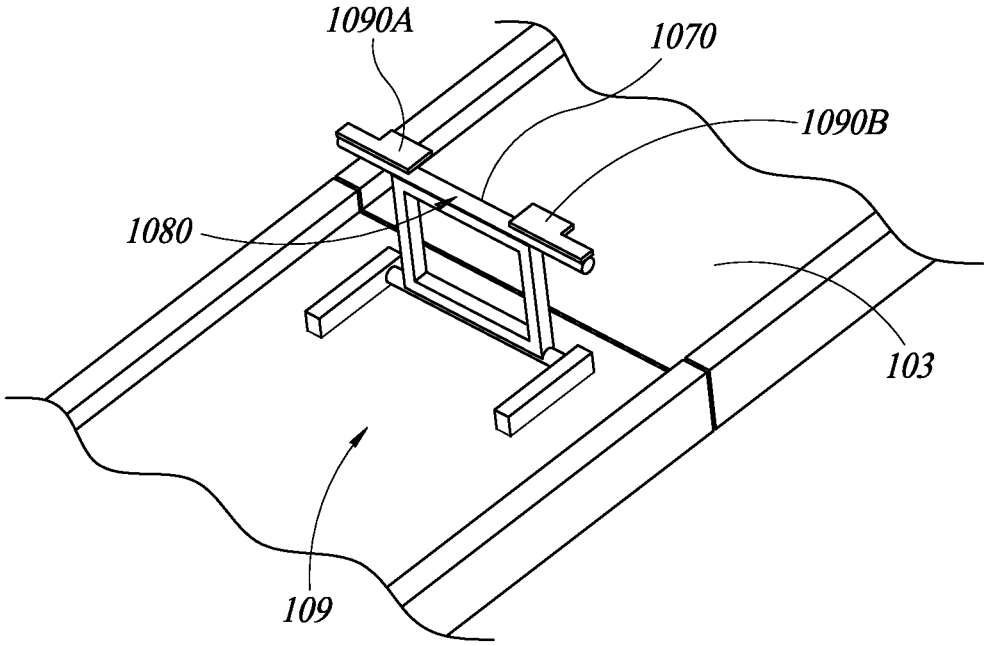
FIG. 12B is a view of a leveling structure unfolded a ramp structure.
Figure 12C:
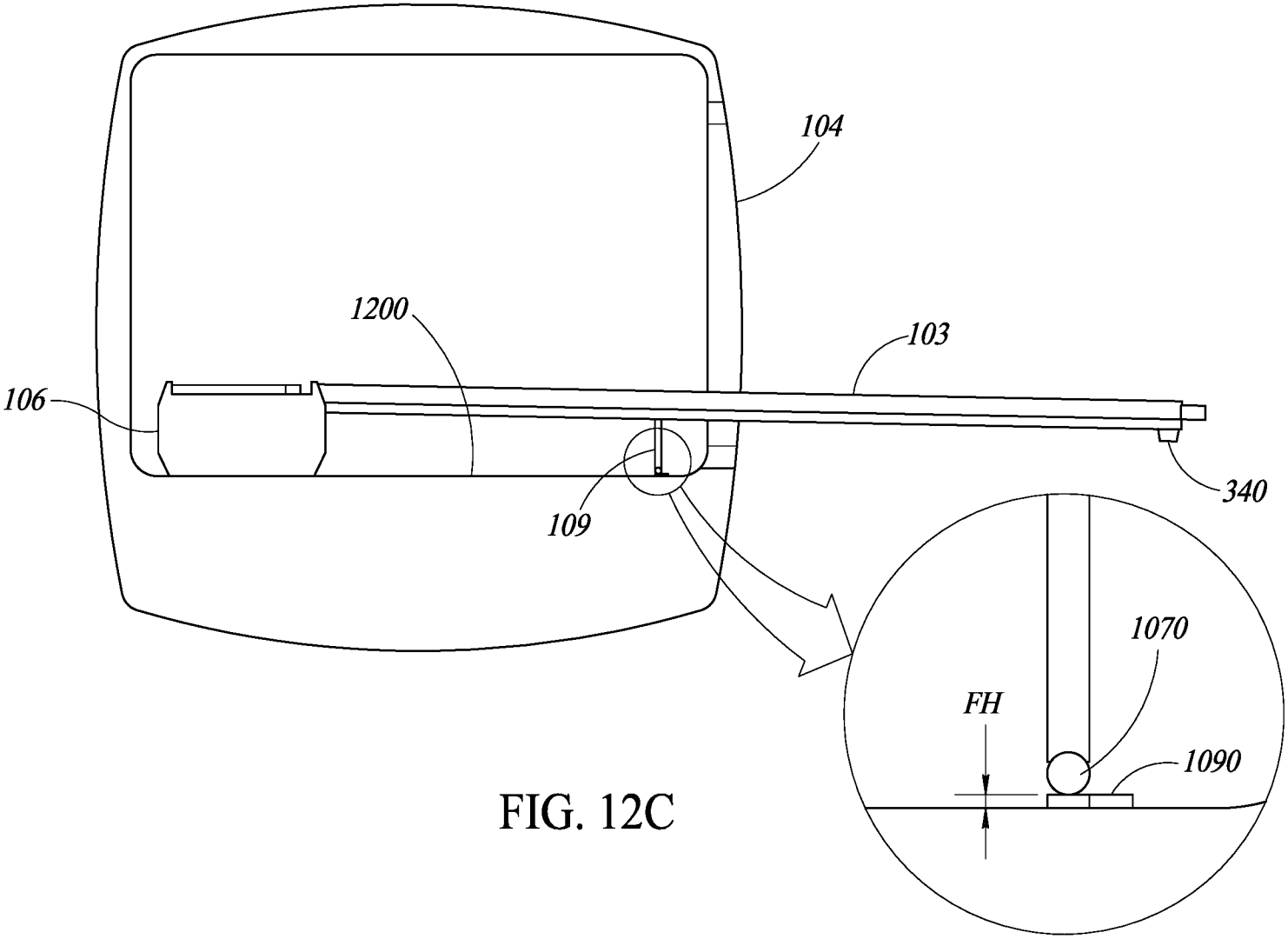
FIG. 12C is a side view of a leveling structure when unfolded and supporting a ramp structure.

FIG. 12A is a view of a leveling structure folded under a ramp structure. FIG. 12B is a view of a leveling structure unfolded a ramp structure. The leveling structure 109 includes a square-shaped frame, a metallic beam 1070 coupled to the bottom of the square-shaped frame, and a metallic feet structures 1090A, 1090B coupled to the metallic beam 1070. A space or a void 1080 exists between a first metallic feet structure 1090A and a second metallic feet structure 1090B. In some embodiments, the first metallic feet structure 1090A and the second metallic feet structure 1090B include an L-shaped metal. The L-shaped metal allows to easily attach to the length direction of the metallic beam 1070. In one embodiment, the metallic beam 1070 includes a cylindrical metal beam. The length of the cylindrical metal beam is wider than the length of the square-shaped frame where the metallic beam 1070 contacts.

FIG. 12C is a side view of a leveling structure when unfolded and supporting a ramp structure. The metallic feet structure 1090 has a height FH. This height FH of the metallic feet structure 1090 provides the void or space 1080 shown in FIGS. 12A and 12B. This space 1080 is particularly beneficial as the L-shaped feet structure 1090A, 1090B can stand where the interior floor surface 1200 is relatively more planar. Having a footing on a planar surface within the interior floor surface 1200 helps avoid any rocking during the transportation of the patient on the moveable base member 130. The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A patient transporting device for loading a patient into a patient loading vehicle, the patient transporting device comprising:

a movable base member configured to receive a patient;

a pathway member configured to provide a movement path for the movable base member;

a docking member positioned adjacent to the pathway member, the docking member configured to mate with a receiving portion of the patient loading vehicle, the docking member including a docking plate having thereon one or more openings, wherein, in operation, the one or more openings of the docking plate is positioned under a plurality of protruding portions of a receiving member of the patient loading vehicle, the receiving member having the plurality of protruding portions from a bottom surface of the receiving member of the patient loading vehicle, wherein, in operation, respective openings to corresponding protruding portions are docked and affixed to form a substantially coplanar path for the moveable base member to slidably move from the pathway member, the docking member, and the receiving portion of the patient loading vehicle.

2. The patient transporting device of claim 1, wherein the docking member includes:

a connecting member on the docking plate, wherein the connecting member is spaced apart from the one or more openings so as to not overlap with the one or more openings, wherein the connecting member includes:

a first sidewall;

a second sidewall facing the first sidewall; and a supporting plane between the first sidewall and the second sidewall.

3. The patient transporting device of claim 2, wherein the one or more openings extends through the docking plate.

4. The patient transporting device of claim 2, wherein the pathway member includes:

a first side frame;

a second side frame facing the first side frame; and a path portion positioned between the first side frame and the second side frame, a first end of the path portion abutting the first side frame and a second end of the path portion opposite of the first end abutting the second side frame, the path portion having a substantially planar top surface, wherein the supporting plane of the docking member is substantially coplanar with the path portion of the pathway member.

5. The patient transporting device of claim 4, wherein the first sidewall of the docking member is substantially coplanar with the first side frame of the pathway member, and the second sidewall of the docking member is substantially coplanar with the second side frame of the pathway member so that the movable base member smoothly moves from the pathway member to the docking member.

6. The patient transporting device of claim 4, wherein the docking plate extends beneath the supporting plane of the docking member and the path portion of the pathway member, the docking plate is affixed to the supporting plane and the pathway member.

7. The patient transporting device of claim 6, further comprising:

a lifter for supporting the pathway member, the lifter configured to elevate the pathway member vertically, and to tilt the pathway member in a selected angle.

8. The patient transporting device of claim 7, wherein the receiving portion of the patient loading vehicle includes:

a loading path having a first surface and a second surface opposite of the first surface; and the receiving member on the second surface, wherein the movable base member, during operation, moves along the first surface of the loading path and into the patient loading vehicle.

9. The patient transporting device of claim 8, wherein the receiving member includes one or more protruding portions on the second surface, the one or more protruding portions having a shape and size that corresponds to a shape and size of the one or more openings of the docking member, wherein the one or more protruding portions extends away from the second surface.

10. The patient transporting device of claim 9, wherein the lifter, in operation, lifts the pathway member having thereon the moveable base member and the docking member and tilts the pathway member and the docking member to dock the one or more openings of the docking plate to the one or more protruding portions of the receiving member at the selected angle.

11. The patient transporting device of claim 10, wherein the supporting plane of the docking member, the path portion of the pathway member, and the first surface of the loading path forms a substantially coplanar surface at the selected angle with respect to each other and in operation, allows the moveable base member to slidably move along from the pathway member to the loading path of the patient loading vehicle via the docking member.

12. The patient transporting device of claim 11, wherein the patient transporting device includes a stretcher.

13. The patient transporting device of claim 11, wherein the patient loading vehicle includes at least one of an aircraft, a helicopter, and an ambulance.

14. The patient transporting device of claim 11, wherein the docking member and the pathway member is formed integrally.

15. The patient transporting device of claim 11, wherein the pathway member has brake members on each of the first side frame and the second side frame, the brake members configured to prevent the moveable base member from sliding down from the pathway member at the selected angle.

16. A method of transporting a patient, the method comprising:

placing a patient on a movable base member on a pathway member of a patient transporting device;

rolling a lifter supporting the pathway member adjacent to a receiving member of an emergency vehicle;

lifting a docking member affixed to the pathway member near the receiving member, the receiving member having a plurality of protruding portions from a bottom surface of the receiving member;

tilting the docking member having a plurality of openings, under the plurality of protruding portions of the receiving member;

hooking each of the plurality of openings of the docking member to each of the plurality of protruding portions of the receiving member, respectively; and forming a path including a path portion of the pathway member, a supporting plane of the docking member, and a loading path of the receiving member of the emergency vehicle at a selected angle, wherein hooking each of the plurality of openings to each of the plurality of protruding portions, respectively includes:

docking respective openings to corresponding protruding portions; and affixing a position of the docking member and the receiving member to form a coplanar surface between the supporting plane of the docking member and the loading path of the receiving member.

17. The method of claim 16, wherein forming the path includes:

forming top surfaces of the path portion, the supporting plane, and the loading path to be substantially coplanar to each other.

18. The method of claim 17, further comprising:

moving the movable base member from the path portion of the pathway member to the loading path of the receiving member via the supporting plane of the docking member at the selected angle.

19. The method of claim 17, further comprising:

releasably unhooking the respective openings from the respective protruding portions, upon the lifter tilting to an angle different from the selected angle.

* * * * *